US010147381B2

(12) United States Patent
Lee et al.

(10) Patent No.: US 10,147,381 B2
(45) Date of Patent: Dec. 4, 2018

(54) DISPLAY DRIVING CIRCUIT AND DISPLAY DRIVING METHOD

(71) Applicant: SAMSUNG ELECTRONICS CO., LTD., Suwon-si, Gyeonggi-do (KR)

(72) Inventors: Jin-woo Lee, Cheonan-si (KR); Hyun-sang Park, Seongnam-si (KR); Hye-Jin Jung, Hwaseong-si (KR); Kyung-chun Kim, Yongin-si (KR)

(73) Assignee: Samsung Electronics Co., Ltd., Suwon-Si, Gyeonggi-do (KR)

( * ) Notice: Subject to any disclaimer, the term of this patent is extended or adjusted under 35 U.S.C. 154(b) by 390 days.

(21) Appl. No.: 14/800,865

(22) Filed: Jul. 16, 2015

(65) Prior Publication Data

US 2016/0093270 A1 Mar. 31, 2016

(30) Foreign Application Priority Data

Sep. 26, 2014 (KR) ..... 10-2014-0129520

(51) Int. Cl.
*G09G 3/36* (2006.01)

(52) U.S. Cl.
CPC ... *G09G 3/3688* (2013.01); *G09G 2310/0291* (2013.01)

(58) Field of Classification Search
None
See application file for complete search history.

(56) References Cited

U.S. PATENT DOCUMENTS

| | | | | |
|---|---|---|---|---|
| 7,271,792 | B2 | 9/2007 | Kato | |
| 7,317,440 | B2 | 1/2008 | Chung | |
| 7,649,519 | B2 | 1/2010 | Seo et al. | |
| 7,750,898 | B2 | 7/2010 | Welbers et al. | |
| 8,310,507 | B2 | 11/2012 | Hiratsuka | |
| 2006/0071893 | A1 | 4/2006 | Nishina et al. | |
| 2007/0195054 | A1 | 8/2007 | Kwon | |
| 2008/0079706 | A1* | 4/2008 | Chia | G06F 1/3203 345/211 |
| 2010/0171731 | A1 | 7/2010 | Tanaka | |
| 2013/0307838 | A1* | 11/2013 | Kim | G09G 5/001 345/212 |

FOREIGN PATENT DOCUMENTS

| | | |
|---|---|---|
| KR | 10-2004-0017157 A | 2/2004 |
| KR | 10-2011-0063980 A | 6/2011 |

* cited by examiner

*Primary Examiner* — Amare Mengistu
*Assistant Examiner* — Shawna Stepp Jones
(74) *Attorney, Agent, or Firm* — Lee & Morse, P.C.

(57) ABSTRACT

A display driving circuit includes a first bias circuit, a second bias circuit, a selector, and an output buffer. The first bias circuit generates a first bias voltage set. The second bias circuit generates a second bias voltage set. The selector selects one of the first and second bias voltage sets based on a bias selection signal. The output buffer buffers a grayscale voltage corresponding to display data and outputs the buffered grayscale voltage The output buffer is biased based on the first or second bias voltage set selected by the selector.

18 Claims, 17 Drawing Sheets

DISPLAY DRIVING CIRCUIT AND DISPLAY DRIVING METHOD

CROSS-REFERENCE TO RELATED APPLICATIONS

Korean Patent Application No. 10-2014-0129520, filed on Sep. 26, 2014, entitled, "Display Driving Circuit and Display Driving Method," is incorporated by reference herein in its entirety.

BACKGROUND

1. Field

One or more embodiments described herein relate to a display driving circuit and a display driving method.

2. Description of the Related Art

The size and resolution of display panels continue to increase. This may require improvements in the slew rates of output buffers for driving source lines and low power operations.

SUMMARY

In accordance with one or more embodiments, a display driving circuit includes a first bias circuit to generate a first bias voltage set; a second bias circuit to generate a second bias voltage set; a selector to select one of the first and second bias voltage sets based on a bias selection signal; and an output buffer to buffer a grayscale voltage corresponding to display data and output the buffered grayscale voltage, the output buffer to be biased based on the first or second bias voltage set selected by the selector.

The output buffer may include a plurality of stages, each of the stages may include an input terminal and an output terminal, and when the first or second bias voltage set selected by the selector is changed, a static current flowing through each of the stages may be changed. The static currents flowing through the stages may be changed at substantially a same rate.

Levels of a plurality of bias voltages of the second bias voltage set may be different from levels of a plurality of bias voltages of the first bias voltage set. An amount of static current of the output buffer when the output buffer is biased by the first bias voltage set may be greater than that of the output buffer when the output buffer is biased by the second bias voltage set.

The bias selection signal may be set based on a difference between a data value of current line data of the display data and a data value of previous line data of the display data. The bias selection signal may be set so that: the first bias voltage set is selected when the difference is equal to or greater than a predetermined reference value, and the second bias voltage set is selected when the difference is less than the predetermined reference value.

The display driving circuit may include control logic to compare current line data of the display data with previous line data of the display data and to generate the bias selection signal based on the comparison result. The control logic may include a line buffer to receive the display data and output the received display data as the previous line data; and a comparator to compare the current line data of the display data with the previous line data of the display data and to generate the bias selection signal based on a result of the comparison.

Voltage levels of a plurality of bias voltages of the first and second bias voltage sets may vary based on a bias control signal. The bias control signal may be set based on a driving load of the output buffer according to one or more characteristics of a display panel. The display driving circuit may include a third bias circuit to generate a third bias voltage set, wherein the selector is to select one of the first through third bias voltage sets based on the bias selection signal.

In accordance with one or more other embodiments, a display driving circuit includes a bias block to generate a plurality of bias voltage sets, each of the bias voltage sets including k bias voltages, where k is a positive integer; and a plurality of drivers to drive a plurality of source lines of a display panel, each of the drivers to receive the bias voltage sets, wherein each of the drivers includes an output buffer to output a grayscale voltage corresponding to display data, to select one of the bias voltage sets based on a change in the display data, and to bias the output buffer based on the k bias voltages of the selected bias voltage set.

The display driving circuit may include control logic to compare previous line data of display data corresponding to each of the drivers with current line data of the display data, to generate a bias selection signal based on a result of the comparison, and to provide the bias selection signal and the display data to a corresponding driver. Each of the drivers may include a selector to select one of the bias voltage sets based on the bias selection signal; and the output buffer may output a grayscale voltage corresponding to the display data.

In accordance with one or more other embodiments, an apparatus for a display device includes an input to receive a bias selection signal; and logic to select a first bias voltage set or a second bias voltage set based on a bias selection signal, the selected one of the first bias voltage set or the second bias voltage set to bias an output buffer for storing a grayscale voltage corresponding to display data, wherein the first bias voltage set corresponds to a first amount of static current of the output buffer and the second bias voltage set corresponds to a second amount of static current of the output buffer.

The logic may include control logic to generate the bias selection signal; and a selector to select the first bias voltage set or the second bias voltage set based on the bias selection signal. The control logic may generate the bias selection signal based on a difference between a data value of current line data of the display data and a data value of previous line data of the display data. The logic may correspond to instructions stored in a storage area. The input may be an input of code implementing the logic.

In accordance with one or more other embodiments, a method for controlling a display device includes storing code in a storage area, the code including: first code to select a first bias voltage set or a second bias voltage set based on a bias selection signal, second code to bias an output buffer based on the selected one of the first bias voltage set or the second bias voltage set, the output buffer to store a grayscale voltage corresponding to display data, wherein the first bias voltage set corresponds to a first amount of static current of the output buffer and the second bias voltage set corresponds to a second amount of static current of the output buffer.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
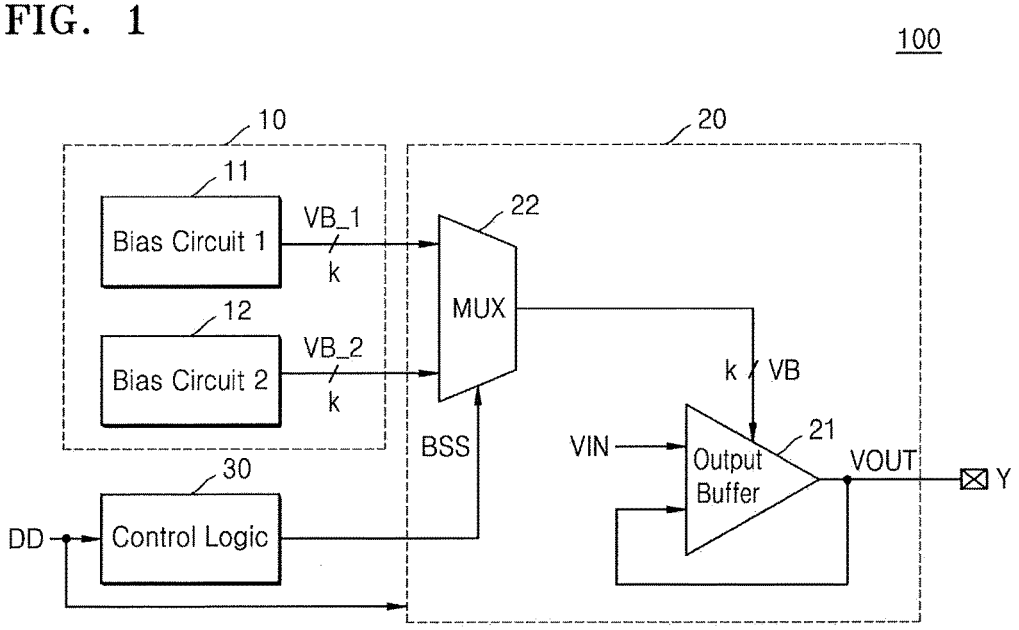
FIG. 1 illustrates an embodiment of a display driving circuit.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

Terms such as "include" or "may include" that may be used in various exemplary embodiments of the inventive concept represent existence of a disclosed corresponding function, operation, or element and do not limit one or more additional functions, operations, or elements. Unless otherwise defined, terms such as "include" and "have" are for representing that characteristics, numbers, steps, operations, elements, and parts described in the specification or a combination of the above exist. It may be interpreted that one or more other characteristics, numbers, steps, operations, elements, and parts or a combination of the above may be added.

In various exemplary embodiments of the inventive concept, a term such as "or" includes certain and all combinations of words listed together. For example, "A or B" may include A, B, or A and B.

It will be understood that, although the terms first and second, etc., may be used herein to describe various elements, these elements should not be limited by these terms. These terms are only used to distinguish one element from another element. For example, the above terms do not limit an order and/or importance of corresponding elements. The above terms may be used to distinguish one element from another element. For example, a first user device and a second user device are all user devices and represent different user devices. For example, a first element may be named a second element and similarly a second element may be named a first element without departing from the scope of the inventive concept.

It will also be understood that when an element is referred to as being "connected to" or as "contacting" another element, it can be directly connected to or can directly contact the other element. However, intervening elements may also be present. On the other hand, when an element is referred to as being "directly connected to" or as "directly contacting" another element, it can be understood that intervening elements do not exist. Unless otherwise defined, a singular term may represent a plural term.

Unless otherwise defined, all terms (including technical and scientific terms) used herein have the same meaning as commonly understood by one of ordinary skill in the art to which this inventive concept belongs.

Figure 2:
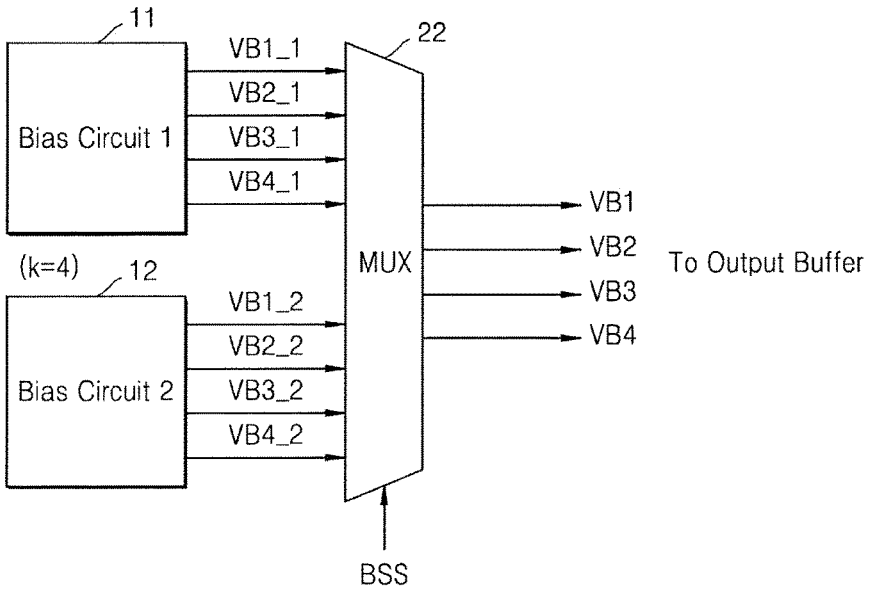
FIG. 2 illustrates an example of bias voltage sets.

FIG. 1 illustrates an embodiment of a display driving circuit 100, and FIG. 2 illustrates an embodiment of bias voltage sets for the display driving circuit 100 of FIG. 1. The display driving circuit 100 may be, for example, a source driver for driving source lines of a display panel or another type of driver.

Referring to FIG. 1, the display driving circuit 100 includes a bias block 10, a driving unit 20, and control logic 30. The bias block 10 generates bias voltages that are provided to an output buffer 21 in the driving unit 20. The bias block 10 may generate and provide two bias voltage sets (e.g., first and second bias voltage sets VB_1 and VB_2) to the driving unit 20.

The bias block 10 includes a first bias circuit 11 for generating a plurality of bias voltages and a second bias circuit 12 for generating a plurality of bias voltages. The first bias circuit 11 may generate the first bias voltage set VB_1 including k bias voltages, and the second bias circuit 12 may generate the second bias voltage set VB_2 including other k bias voltages. Levels of the bias voltages of the first bias voltage set VB_1 and levels of the bias voltages of the second bias voltage set VB_2 may be different from one another.

In an exemplary embodiment, the first bias voltage set VB_1 may include bias voltages for a normal operation of the output buffer 21, and the second bias voltage set VB_2 may include bias voltages for different mode of operation (e.g., any one of a variety of lower power modes of operation or another operational mode based on functionality of a host device) of the output buffer 21.

The driving unit 20 outputs a grayscale voltage corresponding to display data DD to a source line of a display panel. The driving unit 20 may drive one source line or a plurality of source lines under time-shared control. The driving unit 20 includes a selector 22 and an output buffer 21.

The selector 22 receives the first bias voltage set VB_1 and the second bias voltage set VB_2 from the bias block 10, selects one of the first and second bias voltage sets VB_1 and VB_2 based on a bias selection signal BSS, and provides a selected bias voltage set VB to the output buffer 21. For example, when the bias selection signal BSS is at a low level, the selector 22 may select the first bias voltage set VB_1. When the bias selection signal BSS is at a high level, the selector 22 may select the second bias voltage set VB_2.

Referring to FIG. 2, the first bias circuit 11 may generate a predetermined number of (e.g., four) bias voltages VB1_1 to VB4_1, where k is 4. The four bias voltages VB1_1 to VB4_1 generated from the first bias circuit 11 may be referred to as the first bias voltage set VB_1. The second bias circuit 12 may generate an additional predetermined number of (e.g., four) bias voltages VB1_2 to VB4_2. The four bias voltages VB1_2 to VB4_2 generated from the second bias circuit 12 may be referred to as the second bias voltage set VB_2. The selector 22 selects one of the first bias voltage set VB_1 (which includes the four bias voltages VB1_1 to VB4_1) or the second bias voltage set VB_2 (which includes VB1_2 to VB4_2) based on the bias selection signal BSS. The four bias voltages VB1 to VB4 in the selected bias voltage set may be provided to the output buffer 21.

The output buffer 21 buffers a grayscale voltage VIN corresponding to the display data DD to thereby generate an output voltage VOUT. The output voltage VOUT may be output to a source line of a display panel. The output buffer 21 may be implemented with a differential amplifier and, for example, may be a voltage follower having a structure in which the output voltage VOUT is fed back to an input thereof. Accordingly, the level of the output voltage VOUT may be the same as that of the grayscale voltage VIN.

The output buffer 21 may be biased based on k bias voltages of a bias voltage set VB applied from the selector 22. In this case, a static current of the output buffer 21 may be determined according to levels of the k bias voltages, and a slew rate of the output buffer 21 may be determined based on the static current. For example, the slew rate of the output buffer 21 may be relatively high when the static current of the output buffer 21 increases, and may be relatively low when the static current of the output buffer 21 decreases. Accordingly, the output buffer 21 may operate with a high slew rate and at high power or may operate with a low slew rate and at low power. For example, a static current of the output buffer 21 when the first bias voltage set VB_1 is applied to the output buffer 21 may be greater than that of the output buffer 21 when the second bias voltage set VB_2 is applied to the output buffer 21.

In an exemplary embodiment, the output buffer 21 may include a plurality of stages, each including an input terminal and an output terminal. Static currents may respectively flow through stages. In this case, when a bias voltage set VB selected from the selector 22 is changed, the static currents respectively flowing through the stages may be changed. Also, the static currents respectively flowing through the stages may be changed at the same rate.

The control logic 30 generates the bias selection signal BSS based on the display data DD and provides the bias selection signal BSS to the selector 22. The display data DD is a digital signal including a plurality of bits provided to the driving unit 20 to drive a source line of a display panel. The display data DD indicates a grayscale value of light to be emitted by a corresponding a pixel. The display data DD corresponding to each of the pixels connected to the source line is sequentially provided to the driving unit 20. The driving unit 20 sequentially outputs the grayscale voltage VIN corresponding to the display data DD.

In this case, the control logic 30 may generate the bias selection signal BSS based on a change in a data value of the display data DD. When the change in the data value of the display data DD is relatively large (e.g., above a predetermined value), the control logic 30 may generate the bias selection signal BSS having a low level, which indicates a state to select the first bias voltage set VB_1. When the change in the data value of the display data DD is relatively small (e.g., below the predetermined value or another value), the control logic 30 may generate the bias selection signal BSS having a high level, which indicates a state to select the second bias voltage set VB_2.

Figure 3:
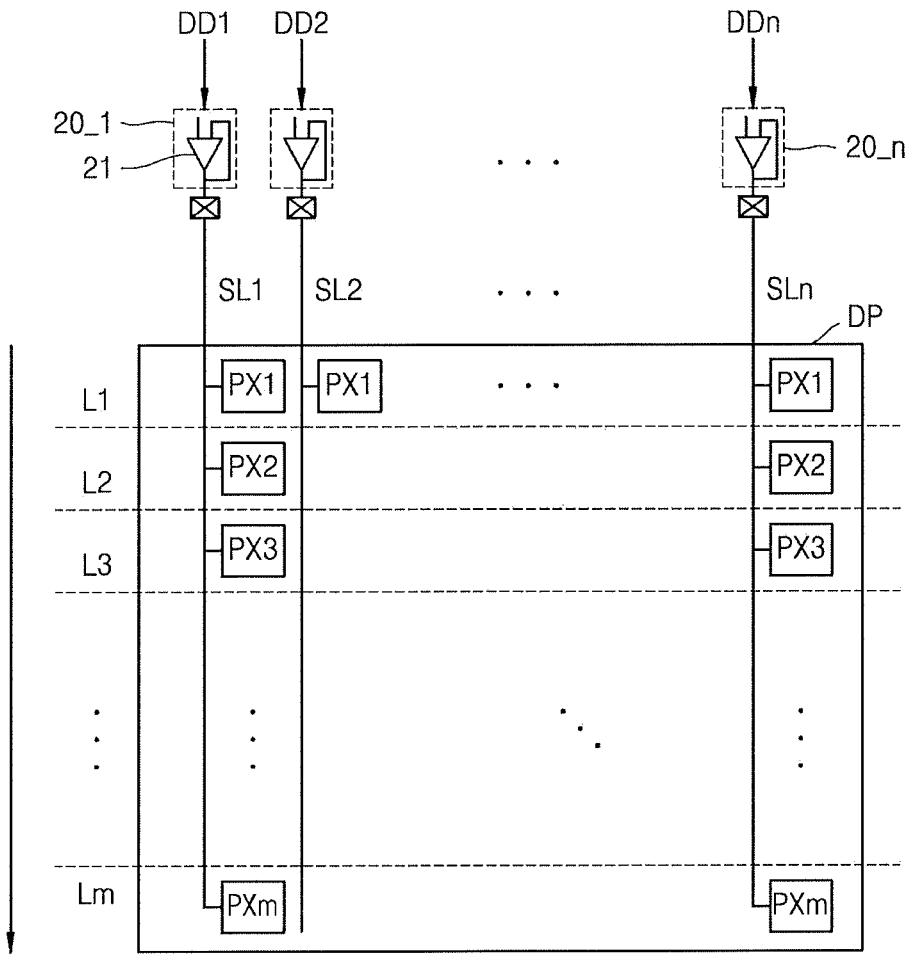
FIG. 3 illustrates an embodiment of a display panel driving scheme.

FIG. 3 illustrates an embodiment of a display panel driving scheme. Referring to FIG. 3, a display panel DP may include a plurality of source lines SL1 to SLn arranged in a column direction. A plurality of pixels PX1 to PXm for different lines (e.g., first through m-th lines L1 to Lm) may be connected to the source lines SL1 to SLn. A plurality of driving units 20_1 to **20_*n* may be connected to the source lines SL1 to SLn and thus may drive the pixels PX1 to PXm connected to the source lines SL1 to SLn. The driving units 20_1 to 20_*n*** may respectively receive display data DD1 to DDn and may respectively provide grayscale voltages to the pixels PX1 to PXm based on the display data DD1 to DDn.

The display panel DP may be sequentially driven in units of horizontal lines. For example, after pixels PX1 in the first line L1 are driven, pixels PX2 in the second line L2 may be driven. In this manner, the first through m-th lines L1 to Lm may be sequentially driven. Accordingly, since data indicating grayscale values of the pixels PX1 to PXm in the lines L1 to Lm are sequentially applied to the driving units 20_1 to **20_*n*** as the display data DD1 to DDn, data values of the display data DD1 to DDn may be changed in units of lines.

Referring again to FIG. 1, the control logic 30 may compare a data value (e.g., current line data) of the display data DD, which corresponds to a pixel in a line to be presently driven in the display panel DP, with a data value (e.g., previous line data) of the display data DD, which corresponds to a pixel positioned in a previously driven line, and may generate the bias selection signal BSS based on a result of the comparison.

For example, the control logic 30 may generate the bias selection signal BSS having a low level when a difference between the previous line data and the current line data is equal to or greater than a predetermined reference value, and may generate the bias selection signal BSS having a high level when the difference between the previous line data and the current line data is less than the predetermined reference value.

According to another embodiment, the control logic 30 may generate the bias selection signal BSS having a low level when a voltage difference between a grayscale voltage depending on the previous line data and a grayscale voltage depending on the current line data is equal to or greater than a predetermined reference value, and may generate the bias selection signal BSS having a high level when the voltage difference is less than the predetermined reference value.

A time for driving each of the first through m-th lines L1 to Lm may be referred to as a horizontal line driving time. A grayscale voltage for each of the pixels PX1 to PXm may be provided within the horizontal line driving time. In this case, the horizontal line driving time may be determined based on a frame frequency of the display panel DP and the number of lines L1 to Lm of the display panel DP, e.g., the number of gate lines.

The output buffer 21 may provide a grayscale voltage for a pixel driven within the horizontal line driving time and may satisfy characteristics of a predetermined setup time. The setup time may be, for example, a maximum or another time for the output buffer 21 to drive one pixel. The output buffer 21 may have a driving capability that enables a pixel to be driven with a predetermined voltage level within the setup time. Characteristics of the setup time may be easily satisfied, for example, when the slew rate of the output buffer 21 is relatively high, but the static current of the output buffer 21 may increase. On the other hand, the static current of the output buffer 21 may decrease when the slew rate of the output buffer 21 is relatively low, but the characteristics of the setup time may not be satisfied.

In accordance with one example embodiment, the display driving circuit 100 generates a plurality of bias voltage sets (e.g., the first and second bias voltage sets VB_1 and VB_2) and selects one of the first or second bias voltage sets VB_1 and VB_2 based on the change in the data value of the display data DD. Accordingly, the display driving circuit 100 may reduce power consumption while satisfying the characteristics of the setup time of the output buffer 21, by adaptively adjusting the slew rate and the static current of the output buffer 21 for an image. Also, the display driving circuit 100 may reduce or prevent an offset of the output buffer 21 from increasing depending on a change in the static current of the output buffer, by adjusting the amount of change in static current flowing through each stage of the output buffer 21.

Figure 4A:
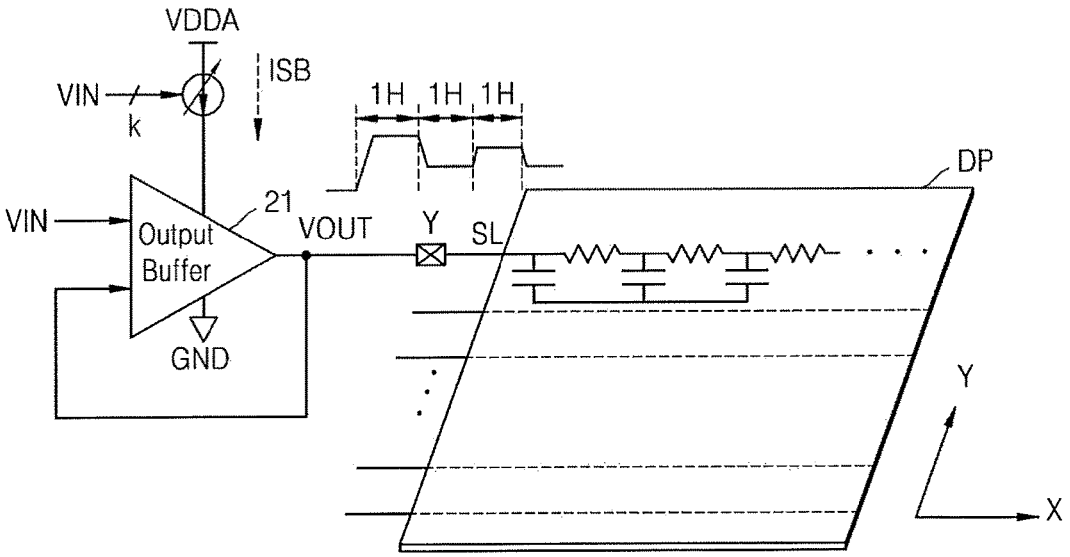
FIGS. 4A and 4B illustrate embodiments for changing a slew rate.
Figure 4B:
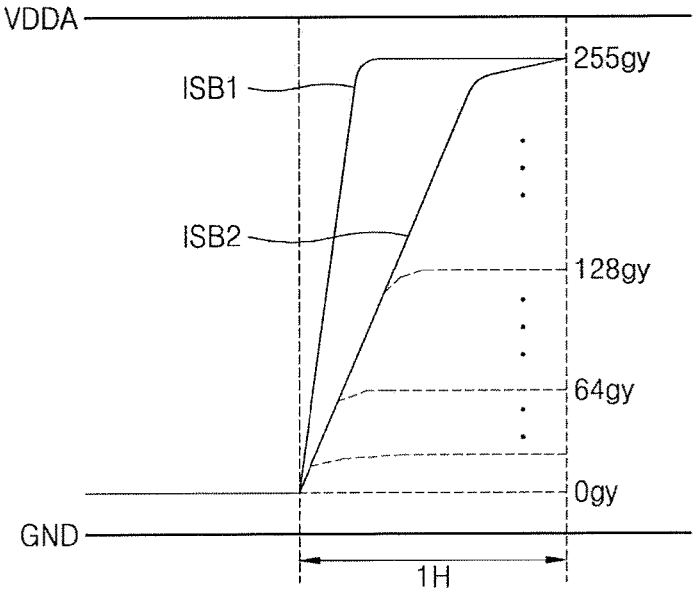

FIGS. 4A and 4B are explaining an embodiment for changing slew rate for a static current of the output buffer 21. As explained with reference to FIG. 3, a plurality of pixels may be connected to the source line SL, and an interconnection line between the pixels and the source line SL may be modeled based on a connection of resistors and capacitors as illustrated, for example, in FIG. 4A. As the display panel DP is sequentially driven in units of lines in a first direction (e.g., X-axis direction), the output buffer 21 outputs, in turn, grayscale voltages for pixels positioned in each line.

The output buffer 21 may output the grayscale voltages within each horizontal line driving time 1H. In this case, due to the resistors and the capacitors, a change of an output voltage VOUT may be delayed in comparison with to a change of a grayscale voltage VIN applied to the output buffer 21. Such a delay may correspond to the slew rate of the output buffer 21. A static current ISB of the output buffer 21 may be changed according to levels of the k bias voltages of the bias voltage set VB applied to the output buffer 21, and thus the slew rate of the output buffer 21 may be changed.

FIG. 4B illustrates an example of a change in the output voltage VOUT of the output buffer 21 with respect to first and second static currents ISB1 and ISB2. The first static current ISB1 indicates a relatively large amount of current and the second static current ISB2 indicates a relatively small amount of current. Accordingly, the slew rate of the output buffer 21 may be relatively high when the first static current ISB1 flows through the output buffer 21, and the slew rate of the output buffer 21 may be relatively low when the second static current ISB2 flows through the output buffer 21.

The slew rate of the output buffer 21 may be changed by adjusting static current flowing through the output buffer 21. In addition, when the output voltage VOUT of the output buffer 21 is changed to the maximum or another value (e.g., the output voltage VOUT is changed from a first or minimum grayscale voltage 0gy to a second or maximum gray scale voltage 250gy), the slew rate and the static current ISB of the output buffer 21 may be set so that a voltage change is accomplished within the horizontal line driving time 1H.

Figure 5A:
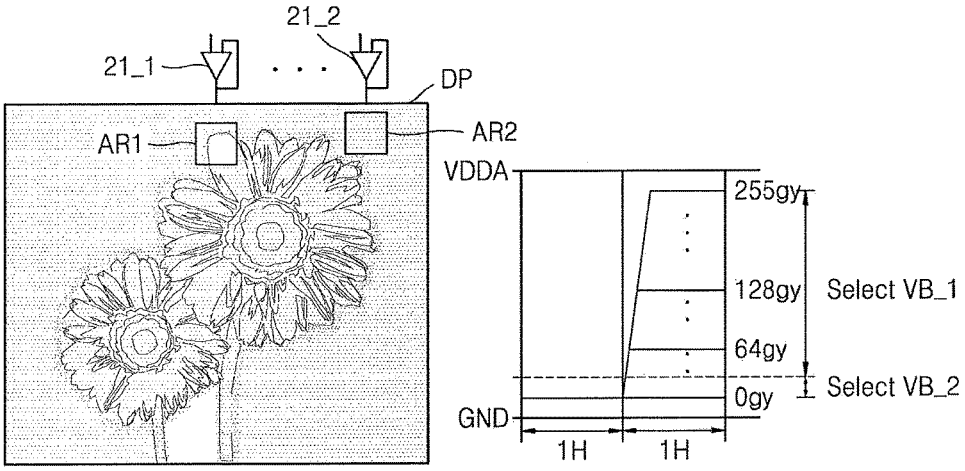
FIGS. 5A through 5C illustrate embodiments for adjusting static current.
Figure 5B:
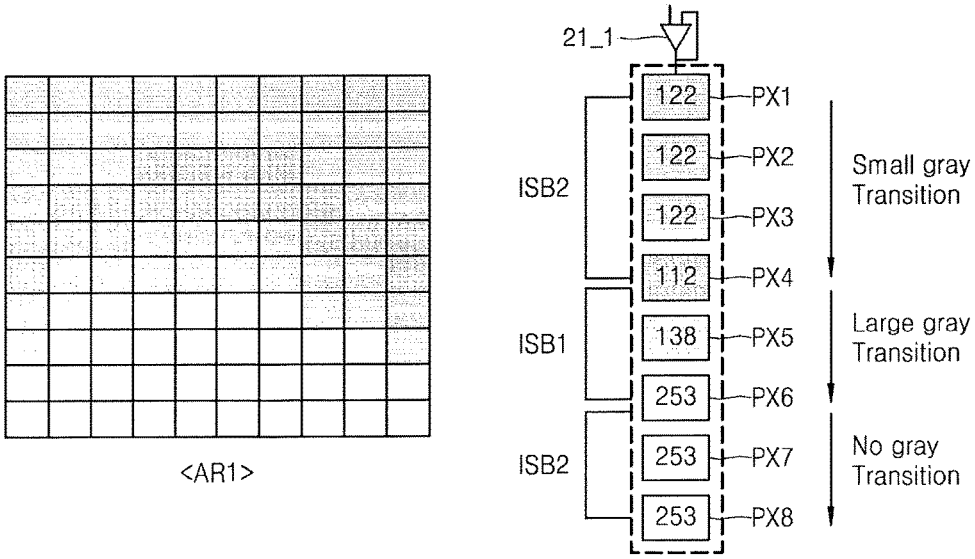
Figure 5C:
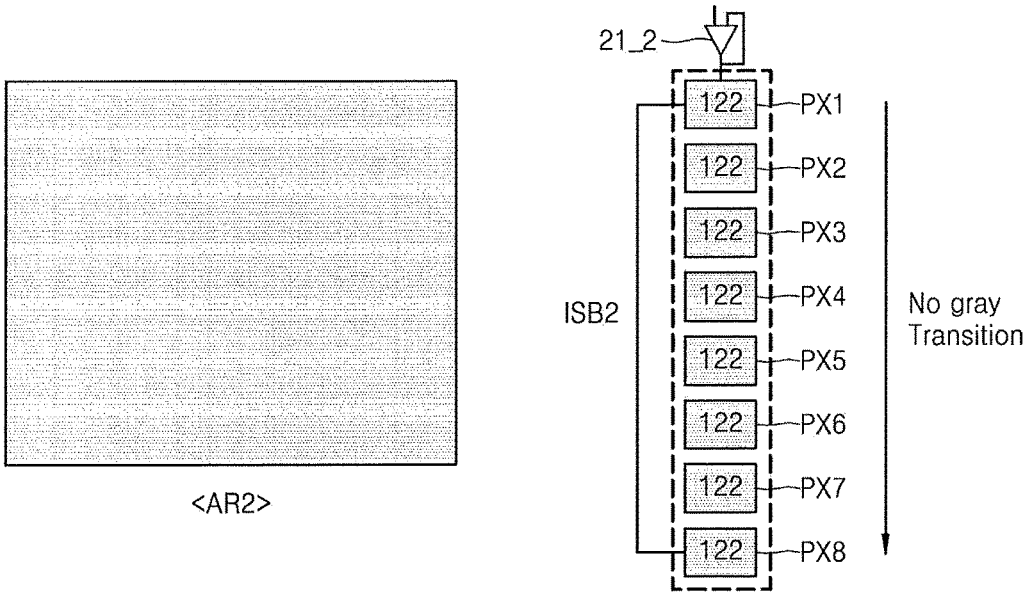

FIGS. 5A through 5C illustrate an embodiment for adjusting static current based on a change in display data. Referring to FIG. 5A, a first output buffer 21_1 may drive a portion of a first area AR1 on a display panel DP, and a second output buffer 212 may drive a portion of a second area AR2 on the display panel DP. As illustrated in FIGS. 5B and 5C, when the first area AR1 and the second area AR2 are magnified, a grayscale change may be relatively large at the boundary of an object and the same or similar grayscale may be displayed in the remaining part. In this case, as illustrated in FIGS. 5B and 5C, a static current ISB may be increased when a grayscale change between pixels, which are driven by the first output buffer 21_1 or the second output buffer 21_2, is relatively large, e.g., above a value. The static current ISB may be decreased when the grayscale change between the pixels, which are driven by the first output buffer 21_1 or the second output buffer 21_2, is relatively small, e.g., below the value or another value. For example, the static current ISB may be adaptively adjusted in regard to an image.

As described above, the display driving circuit 100 according to the current exemplary embodiment may select the first bias voltage set VB_1 when a grayscale change between pixels is relatively large and thus may increase the static current ISB. The display driving circuit 100 may select the second bias voltage set VB_2 when the grayscale change between the pixels is relatively small and thus may decrease the static current ISB.

In FIG. 5B, numbers in the boxes corresponding to the pixels indicate grayscale values for the first through eighth pixels PX1 to PX8. There is no grayscale change from the first pixel PX1 to the third pixel PX3, the grayscale change is relatively small between the third pixel PX3 and the fourth pixel PX4, and the grayscale change is relatively large from the fourth pixel PX4 to the sixth pixel PX6. There is no grayscale change from the sixth pixel PX6 to the eighth pixel PX8. Thus, when driving the fifth pixel PX5 and the sixth pixel PX6, the output buffer 21_1 may be controlled so that a relatively large static current ISB1 flows through the first output buffer 21_1. In other driving periods, the output buffer 21_1 may be controlled so that a relatively small static current ISB2 flows through the first output buffer 21_1.

Referring to FIG. 5C, there is no grayscale change between each of the first through eighth pixels PX1 to PX 8 in the second area AR2. Thus, the second output buffer 21_2 may be controlled so that a relatively small static current ISB2 flows through the second output buffer 21_2.

By adaptively adjusting the static current of each output buffer in this manner for an image displayed on the display unit DP, power consumption may be reduced while slew rate characteristics of the output buffer are satisfied.

Figure 6:
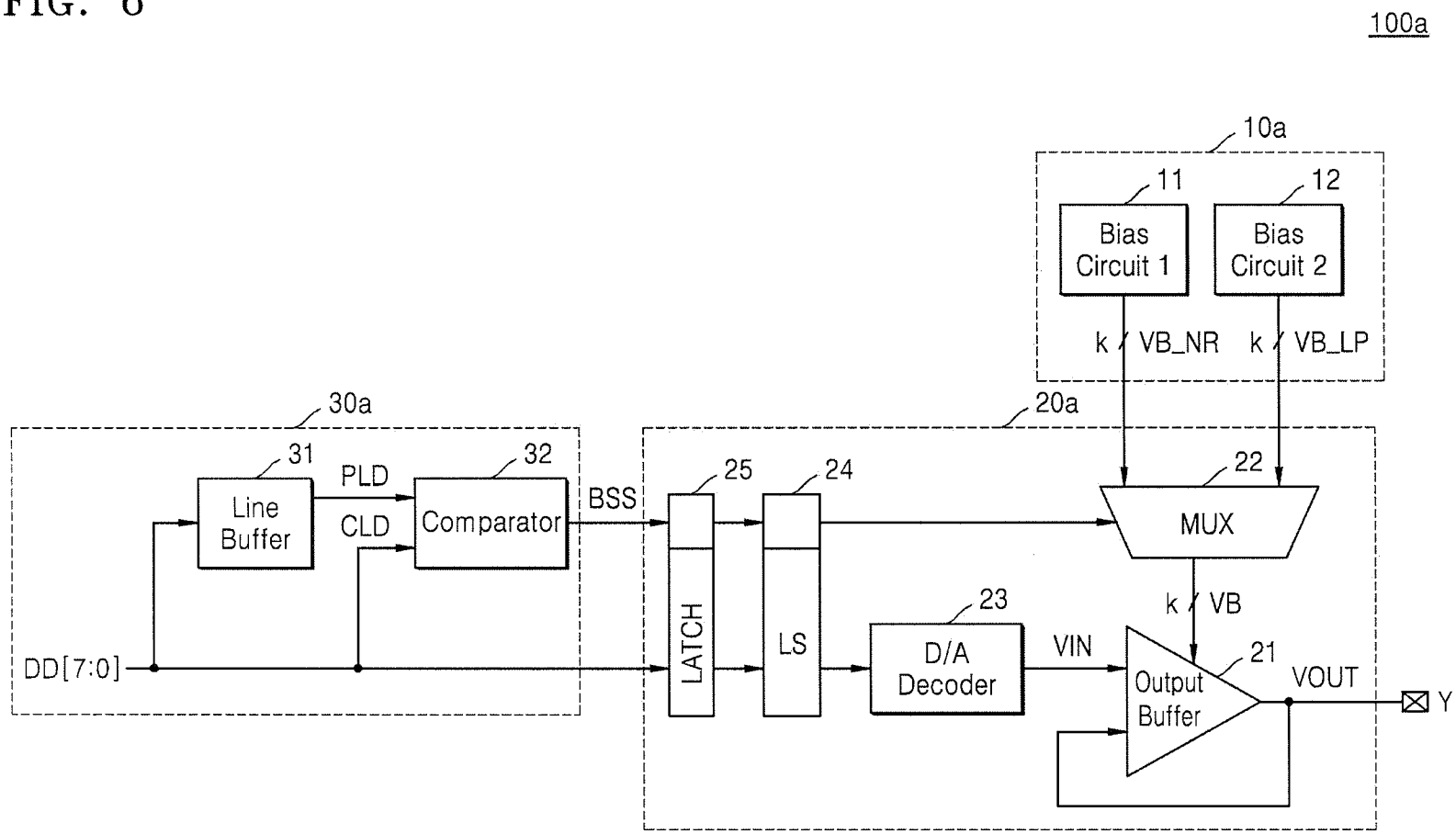
FIG. 6 illustrates a more detailed embodiment of the display driving circuit.

FIG. 6 illustrates another embodiment of a display driving circuit 100*a*, which, for example, may represent a more detailed embodiment of the display driving circuit 100 of FIG. 1.

Referring to FIG. 6, the display driving circuit 100*a* includes a bias block 10*a*, a driving unit 20*a*, and a control logic 30*a*. The bias block 10*a* includes a first bias circuit 11 that generates and outputs a first bias voltage set VB_NR, and a second bias circuit 12 that generates and outputs a second bias voltage set VB_LP. The first bias voltage set VB_NR may be a normal mode bias voltage set and the second bias voltage set VB_LP may be another mode (e.g., low power mode) bias voltage set.

In an exemplary embodiment, levels of a plurality of bias voltages in the first bias voltage set VB_NR and levels of a plurality of bias voltages in the second bias voltage set VB_LP may vary based on characteristics of the display panel DP. For example, when the resistors or capacitors of the display panel DP are relatively large, the levels of the plurality of bias voltages may be adjusted so that the static current ISB of the output buffer 21 increases, in order to increase a driving capability of the output buffer 21. In this case, a bias control signal may be applied to the first bias circuit 11 and the second bias circuit 12, and the first bias circuit 11 and the second bias circuit 12 may adjust the levels of the bias voltages based on the bias control signal. For example, device values of devices (e.g., resistors) in the first and second bias circuit 11 and 12 may increase or decrease based on the bias control signal, and thus the levels of the bias voltages may be adjusted.

The driving unit 20*a* includes a selector 22, an output buffer 21, a digital-analog decoder 23, and a latch 25. The driving unit 20*a* may further include a level shifter 24. The selector 22 and the output buffer 21 may be the same as those described with reference to FIG. 1.

The latch 25 receives and stores a bias control signal BSS and display data DD[7:0] from the control logic 30*a*. The display data DD[7:0] includes a plurality of bits, e.g., the display data DD[7:0] may be a 8 bit signal. The bias control signal BSS may be, for example, a 1 bit signal.

The level shifter 24 may raise a voltage level of the bias control signal BSS and a voltage level of the display data DD[7:0] so that the bias control signal BSS and the display data DD[7:0], which are digital signals, may be used in analog circuits, e.g., the selector 22 and the digital-analog decoder 23.

The digital-analog decoder 23 receives a plurality of grayscale voltages, selects a grayscale voltage VIN of the grayscale voltages which corresponds to the display data DD[7:0], and provides the grayscale voltage VIN to the output buffer 21. When the display data DD[7:0] is a 8 bit signal, one of 256 grayscale voltages may be selected.

As described above with reference to FIG. 1, the control logic 30*a* may generate the bias selection signal BSS based on a change in a data value of the display data DD[7:0]. The control logic 30*a* may include a line buffer 31 and a comparator 32. The line buffer 31 may store a portion of the display data DD[7:0] and may delay the portion of the display data DD[7:0] by a predetermined time to output delayed data as previous line data PLD. The predetermined time may be, for example, one horizontal line driving time 1H.

The comparator 32 may receive the previous line data PLD output from the line buffer 31 and current line data CLD that is at least some of currently input display data DD[7:0] and compares the previous line data PLD with the current line data CLD to generate the bias selection signal BSS. The bias selection signal BSS may be a signal having at least one bit. For example, when the bias block 10*a* includes two bias circuits 11 and 12, the bias selection signal BSS may be a one bit signal. The bias selection signal BSS may be a signal indicating a normal operation mode or low power operation mode of the output buffer 21.

In an exemplary embodiment, the comparator 32 may generate the bias selection signal BSS having a first level (e.g., a low level) when a difference between a data value of the previous line data PLD and a data value of the current line data CLD is equal to or greater than a reference value. Also, the comparator 32 may generate the bias selection signal BSS having a second level (e.g., a high level) when the difference between the data value of the previous line data PLD and the data value of the current line data CLD is less than the reference value. The reference value may be set in advance based on characteristics of the display panel DP, characteristics of the output buffer 21, and the number of total grayscale values.

In an exemplary embodiment, a value corresponding to a predetermined ratio to or fraction of the number of total grayscale values that are able to be displayed on the display panel DP may be set as the reference value. For example, when the number of total grayscale values is 256, the reference value may be set to 76 which corresponds to about 30% of 256. In this case, the bias selection signal BSS may be generated based on whether a difference between a data value of the previous line data PLD and a data value of the current line data CLD is equal to or greater than 76 or is less than 76. In another embodiment, the reference value may be set to a different value.

In another exemplary embodiment, the comparator 32 may compare one or more upper bits of the previous line data PLD with one or more upper bits of the current line data CLD to determine the amount of change in a data value of the display data DD[7:0].

The bias selection signal BSS output from the comparator 32 may be provided to the driving unit 20*a* along with the display data DD[7:0], and may be used to select the bias voltage set VB for adjusting the static current ISB of the output buffer 21.

In the current exemplary embodiment, the control logic 30*a* is separate from the driving unit 20*a*. However, the control logic 30*a* may be implemented in the driving unit 20*a* in another embodiment.

Figure 7:
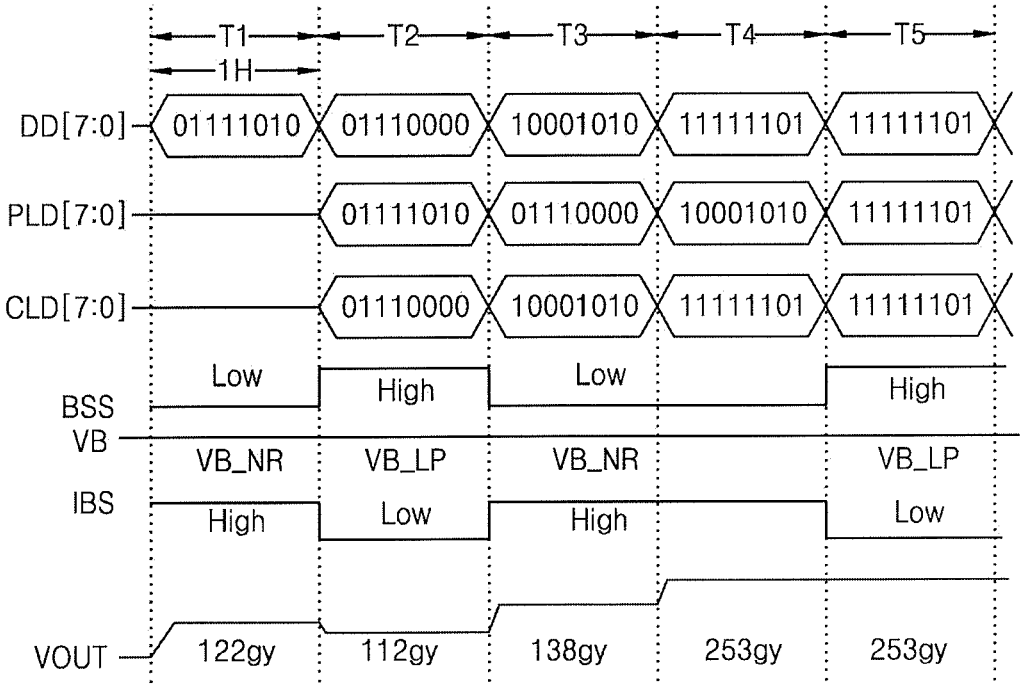
FIG. 7 illustrates an embodiment of control signals for the display driving circuit.

FIG. 7 is a timing diagram illustrating an example of control signals for the display driving circuit of FIG. 6. In FIG. 6, the comparator 32 determines that a grayscale change is relatively small when a change in a data value of the display data DD[7:0] is less than 20 grayscale values, e.g., the difference between a data value of the previous line data PLD and a data value of the current line data CLD is less than 20 grayscale values. Thus, the output buffer 21 is driven in a lower power mode.

Referring to FIG. 7, display data DD[7:0] may be received in first to fifth periods T1 to T5. Each of the first to fifth periods T1 to T5 may correspond to one horizontal line driving time 1H. Five pieces of display data DD[7:0] received in the first to fifth periods T1 to T5 may be different from each other or the same. The output voltage VOUT indicates a grayscale value corresponding to display data DD[7:0] received in each of the first to fifth periods T1 to T5 and may be output from the output buffer 21. Display data DD[7:0] received in the first through fourth periods T1 to T4 may be stored in the line buffer 31 of the control logic 30*a*, and then may be output as previous line data PLD[7:0] in the second through fifth periods T2 to T5. The previous line data PLD[7:0] may be provided to the comparator 32 of the control logic 30*a*.

The display data DD[7:0] received in the first to fifth periods T1 to T5 may be provided to the comparator 32 as current line data CLD[7:0]. In each of the first to fifth periods T1 to T5, the comparator 32 may compare the previous line data PLD[7:0] with the current line data CLD[7:0] and thus generate a bias selection signal BSS. In the second period T2 and the fifth period T5, a difference between a data value of the previous line data PLD[7:0] and a data value of the current line data CLD[7:0] is less than 20 grayscale values. Thus, the bias selection signal BSS is set to a second level, e.g., a high level. Thus, the second bias voltage set VP LP may be selected and be applied to the output buffer 21. Accordingly, the static current IBS of the output buffer 21 may decrease, and thus the output buffer may perform a low power operation.

In the third period T3 and the fourth period T4, a difference between a data value of the previous line data PLD[7:0] and a data value of the current line data CLD[7:0] is 20 grayscale values or more. Thus, the bias selection signal BSS is set to a first level, e.g., a low level. Thus, the first bias voltage set VP_NR may be selected and applied to the output buffer 21. Accordingly, the static current IBS of the output buffer 21 may increase. Thus, the output buffer 21 may perform a normal operation.

The bias selection signal BSS may be basically set to the first level (low level). Since display data applied in a previous period is not in the first period T1, the comparator 32 may not normally operate. In this case, since the bias selection signal BSS is at the first level, the first bias voltage set VB_NR may be applied to the output buffer 21 and the static current IBS of the output buffer 21 may increase.

Referring to FIG. 7, when a change width of the output voltage VOUT is relatively large as in the first, third, and fourth periods T1, T3, and T4, the static current IBS of the output buffer 21 may increase. Thus, the slew rate of the output buffer 21 may increase. When a change width of the output voltage VOUT is relatively small as in the second and fifth periods T2 and T5, the static current IBS of the output buffer 21 may decrease. Thus, the slew rate of the output buffer 21 may decrease to thereby reduce current consumption.

Figure 8:
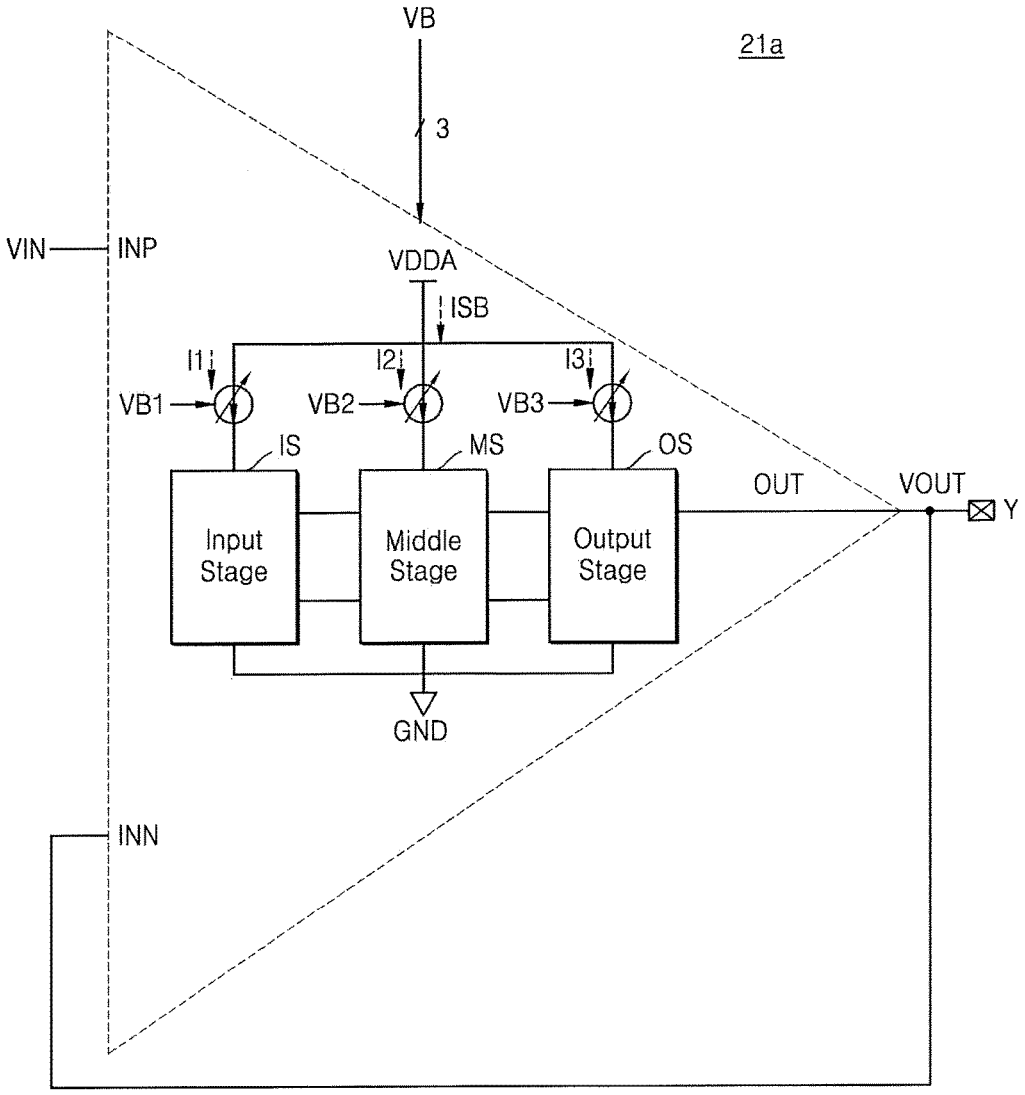
FIG. 8 illustrates an embodiment to explain static current for an output buffer.

FIG. 8 illustrates an embodiment for explaining static current of an output buffer 21*a*. Referring to FIG. 8, the output buffer 21*a* may include an input stage IS, a middle stage MS, and an output stage OS. A static current I1 of the input stage IS may be controlled based on a bias voltage VB1 in a bias voltage set VB, a static current I2 of the middle stage MS may be controlled based on a bias voltage VB2 in the bias voltage set VB, and a static current I3 of the output stage OS may be controlled based on a bias voltage VB3 in the bias voltage set VB. Accordingly, the total static current ISB of the output buffer 21*a* may be adjusted.

A change rate of each of the static currents I1, I2, and I3 may be the same as that of the total static current ISB of the output buffer 21*a*. For example, if it is assumed that the amount of static current ISB when the second bias voltage set VB_2 in the display driving circuit 100 of FIG. 1 is selected and the output buffer 21*a* performs a low power operation is about 30% of the amount of static current ISB when the first bias voltage set VB_1 in the display driving circuit 100 of FIG. 1 is selected and the output buffer 21*a* performs a normal operation, a static current I1 of the input stage IS, a static current I2 of the middle stage MS, and a static current I3 of the output stage OS in the lower power operation may be about 30% of a static current I1 of the input stage IS, about 30% of a static current I2 of the middle stage MS, and about 30% of a static current I3 of the output stage OS in the normal operation, respectively.

The output buffer 21*a* of FIG. 8 is illustrated to have three stages. The output buffer 21*a* may have a different number of stages in another embodiment, e.g., at least two stages including the input stage IS and the output stage OS. In addition, in one embodiment the static current I1 of the input stage IS, the static current I2 of the middle stage MS, and the static current I3 of the output stage OS are controlled by the bias voltage VB1, the bias voltage VB2, and the bias voltage VB3, respectively. In another embodiment, the static current I1 of the input stage IS, the static current I2 of the middle stage MS, and the static current I3 of the output stage OS may be controlled by at least one of the bias voltages VB1, VB2, or VB3. Also, the bias voltages VB1, VB2, and VB3 may be organically used to control the static currents I1, I2, and I3.

Figure 9:
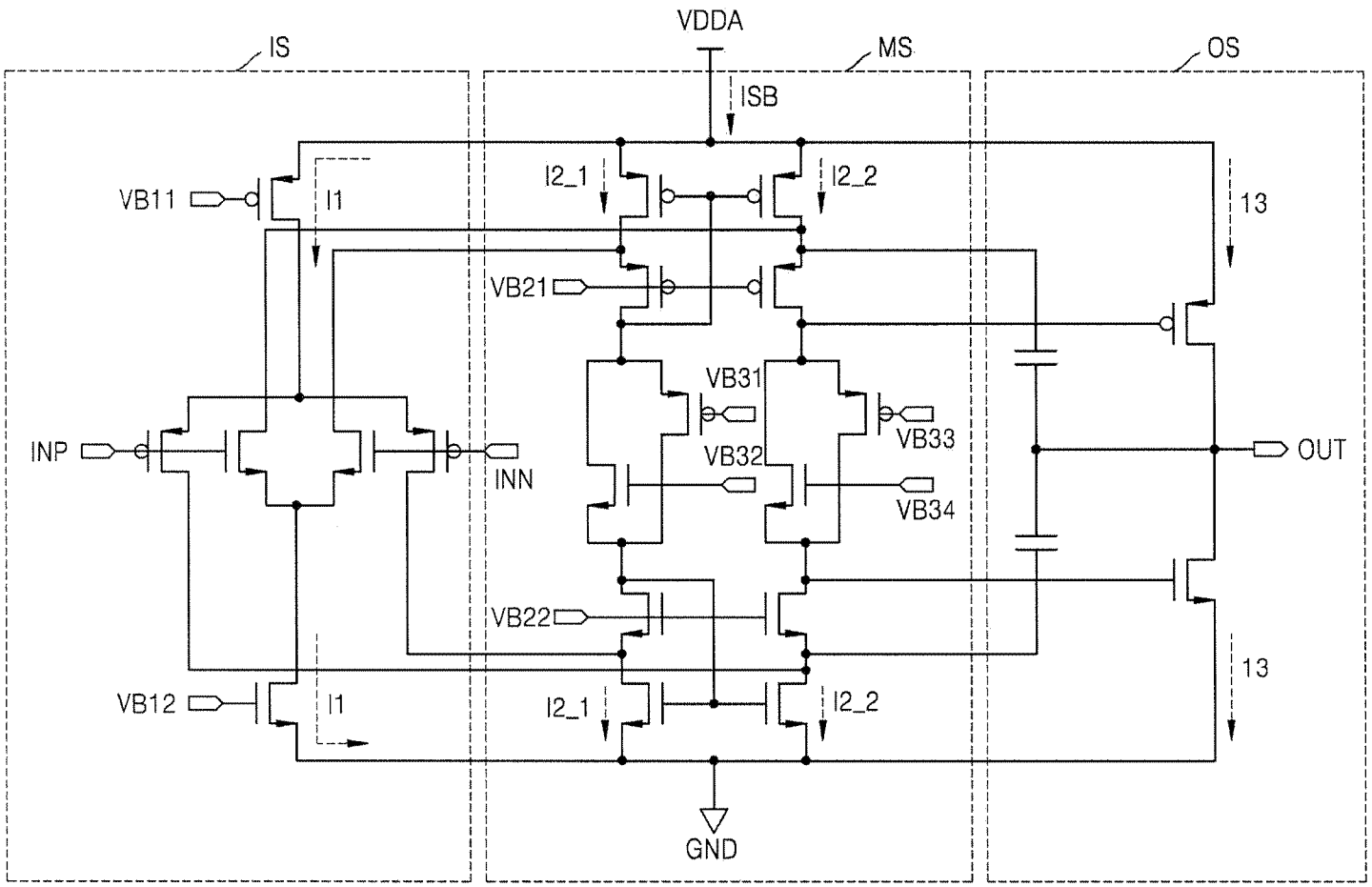
FIG. 9 illustrates an embodiment of an output buffer.

FIG. 9 illustrates an embodiment of an output buffer 21*a* implemented by a plurality of PMOS transistors, NMOS transistors, and capacitors, and which includes an input state IS, a middle stage MS, and an output stage OS.

The input stage IS receives an input signal (e.g., from an external source) and has a differential mode input structure. The middle stage MS receives signals output from the input stage IS and amplify the received signals. For example, the middle stage MS may have a folded cascode structure and may perform an operation such as a current mirroring. The output stage OS outputs an output voltage through an output terminal OUT based on signals output from the middle stage MS.

A static current I1 flowing through the input stage IS, static currents I2_1 and I2_2 flowing through the middle state MS, and a static current I3 flowing through the output stage OS may be controlled by a plurality of bias voltages VB11, VB12, VB21, V22, VB31, VB32, VB33, and VB34.

When voltage levels of some of the plurality of bias voltages VB11, VB12, VB21, V22, VB31, VB32, VB33, and VB34 are changed to control a slew rate of the output buffer 21*a*, a current ratio between the static currents I1, I2_1 and I2_2, and I3 may be changed. Thus, an offset of the output buffer 21*a* may increase. However, in one example embodiment of the display driving circuit 100 (refer to FIG. 1), the bias block 10 may generate a plurality of bias voltage sets VB_1 and VB_2, and one of the bias voltage sets VB_1 and VB_2 may be selected according to an operation mode of the output buffer 21*a*. Also, voltage levels of the bias voltages VB11, VB12, VB21, V22, VB31, VB32, VB33, and VB34, which may be in each of the bias voltage sets VB_1 and VB_2, may be set so that the current ratio between the static currents IL I2_1 and I2_2, and I3, which flow through the input stage IS, middle stage MS, and output stage OS of the output buffer 21*a*, respectively, is maintained to be constant. Thus, although a bias voltage set that is selected by the selector 22 is changed and thus a slew rate of the output buffer 21*a* is changed, the current ratio between the static currents I1, I2_1 and I2_2, and I3, which flow through the input stage IS, middle stage MS, and output stage OS of the output buffer 21*a*, respectively, is not changed. As a result, an offset of the output buffer 21*a* may be prevented from increasing.

Figure 10:
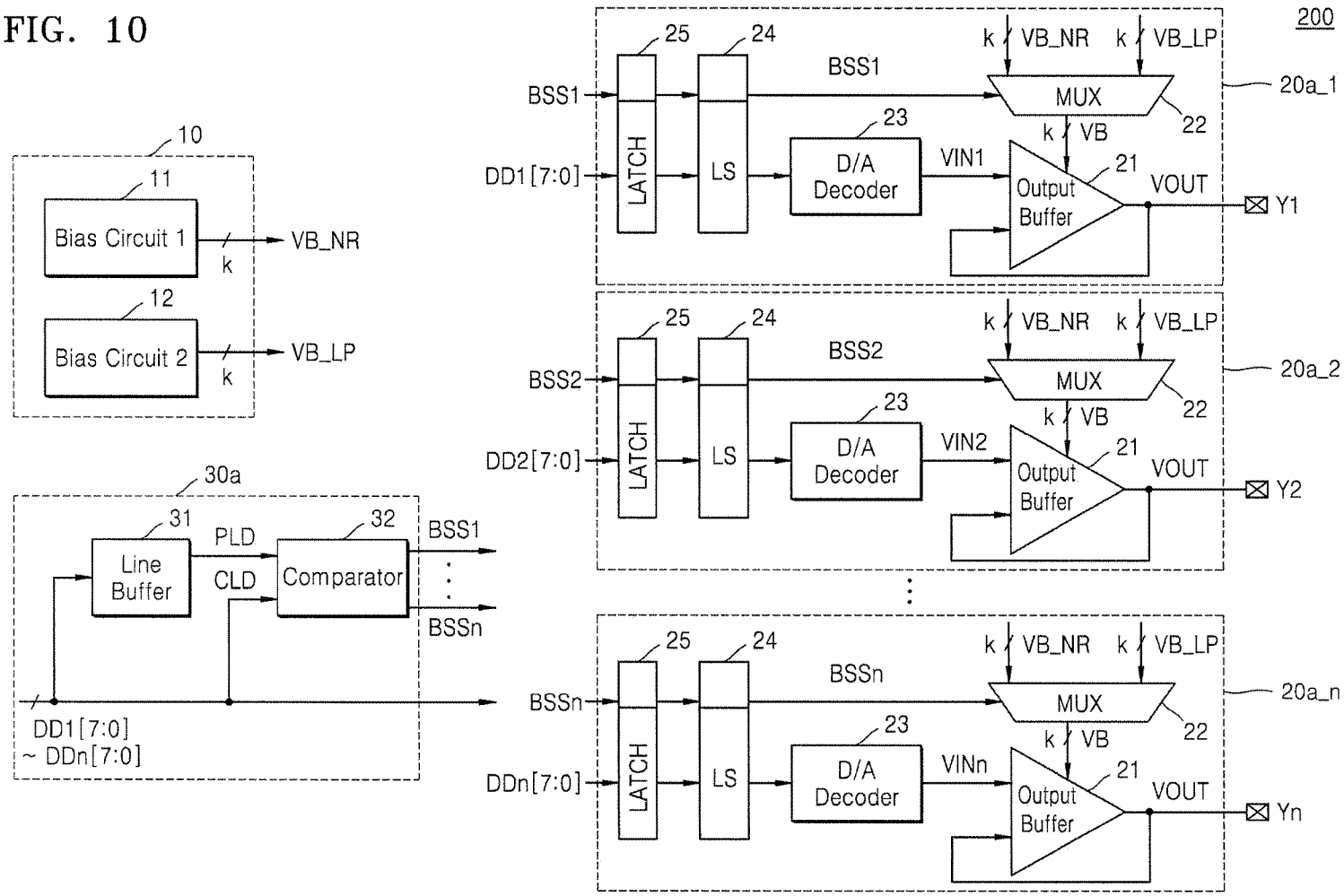
FIG. 10 illustrates another embodiment of a display driving circuit.

FIG. 10 illustrates another embodiment of a display driving circuit 200 which includes a bias block 10, a plurality of driving units 20*a*_1 to 20*a*_*n*, and a control logic 30*a*. The bias block 10 may be the same as the bias blocks 10 and 10*a* of the display driving circuits 100 and 100*a* of FIGS. 1 and 6. The driving units 20*a*_1 to 20*a*_*n* may have the same structure. Each of the driving units 20*a*_1 to 20*a*_*n* may receive a first bias voltage set VB_NR and a second bias voltage set VB_LP and may select one of the first and second bias voltage sets VB_NR and VB_LP as a bias voltage set VB based on a corresponding one of bias voltage selection signals BSS1 to BSSn. The structures and operations of the driving units 20*a* 1 to 20*a*_*n* may be similar to those of the driving unit 20*a* of FIG. 6.

The control logic 30*a* generates the bias voltage selection signals BSS1 to BSSn based on the amount of change in each of a plurality of portions (or bits) of display data DD1[7:0] to DDn[7:0]. The bias selection signals BSS1 to BSSn may be provided to the driving units 20*a*_1 to 20*a*_*n*, respectively. The bias selection signals BSS1 to BSSn may be provided to the driving units 20*a*_1 to 20*a*_*n* along with the display data DD1[7:0] to DDn[7:0], respectively. Accordingly, each of the driving units 20*a*_1 to 20*a*_*n* may select a bias voltage set VB based on a corresponding one of the plurality of portions (or bits) of display data DD1[7:0] to DDn[7:0], respectively, to control a static current IS.

Figure 11:
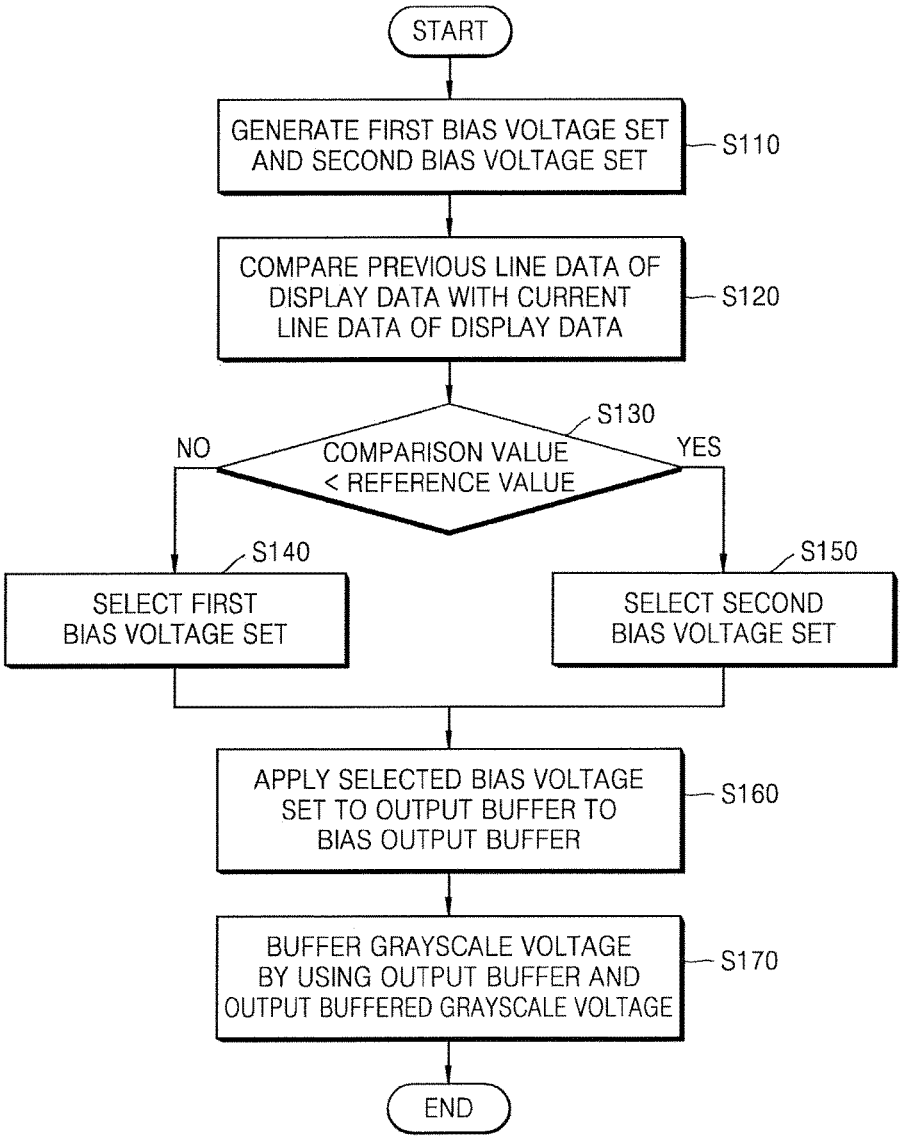
FIG. 11 illustrates an embodiment of a display driving method.

FIG. 11 illustrating an embodiment of a display driving method. Referring to FIG. 11, the method includes generating a first bias voltage set and a second bias voltage set (operation S110). The first bias voltage set and the second bias voltage set may include the same number of bias voltages, e.g., bias voltages corresponding to voltages applied to an output buffer for biasing. In an exemplary embodiment, the first bias voltage set may include bias voltages for a normal operation of an output buffer, and the second bias voltage set may include bias voltages for a low power operation of the output buffer.

Previous line data of display data are compared with current line data of the display data (operation S120). The display data is digital data indicating a grayscale corresponding to a pixel that is driven by the output buffer. The display data may be changed to correspond to pixels that are sequentially driven by the output buffer. The current line data of the display data denotes display data corresponding to a pixel to be currently driven by the output buffer. The previous line data of the display data denotes display data corresponding to a pixel previously driven by the output buffer.

A determination is then made as to whether a comparison value between the previous line data and the current line data is less than a reference value (operation S130). If the comparison value is equal to or greater than the reference value, the first bias voltage set is selected (operation S140). If the comparison value is less than the reference value, the second bias voltage set is selected (operation S150). When the comparison value between the previous line data and the current line data is less than the reference value, a change width of a voltage output from the output buffer is not relatively large. Thus, it does not matter whether the slew rate of the output buffer is relatively low. Accordingly, the second bias voltage set may be selected so that the output buffer performs a low power operation, e.g., the static current of the output buffer decreases.

A selected bias voltage set is applied to the output buffer to bias the output buffer (operation S160). The output buffer buffers a grayscale voltage, which is applied to an input terminal thereof, and outputs the buffered grayscale voltage to a source line (operation S170). Operation S120 through operation S170 may be repeatedly performed whenever each line of a display panel is driven.

Figure 12:
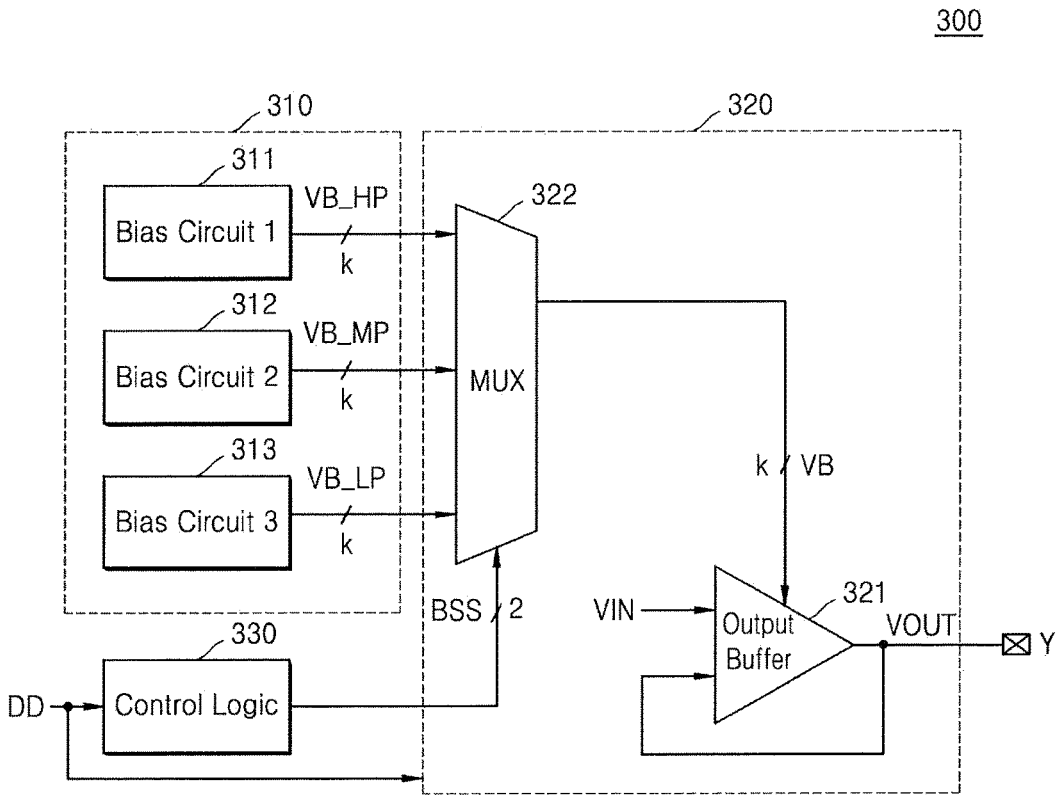
FIG. 12 illustrates another embodiment of a display driving circuit.

FIG. 12 illustrates another embodiment of a display driving circuit 300, which may have a structure and operation which are the same as the display driving circuit 100 of FIG. 1. However, a bias block 310 in the display driving circuit 300 of FIG. 12 may include a third bias circuit 313 as well as the first and second bias circuits 311 and 312.

The first bias circuit 311, the second bias circuit 312, and the third bias circuit 313 may generate a first bias voltage set VB_HP, a second bias voltage set VB_MP, and a third bias voltage set VB_LP, respectively. In an exemplary embodiment, the first bias voltage set VP HP may include bias voltages for a high power operation of an output buffer 321, the second bias voltage set VB_MP may include bias voltages for a medium power operation of the output buffer 321, and the third bias voltage set VB_LP may include bias voltages for a low power operation of the output buffer 321.

A selector 322 of a driving unit 320 may select one of the first through third bias voltage sets VB_HP, VB_MP, and VB_LP as a bias voltage set VB that is applied to the output buffer based on a bias control signal BSS. Since one of the first through third bias voltage sets VB_HP, VB_MP, and VB_LP has to be selected, the bias selection signal BSS may include at least two bits.

A control logic 330 may generate the bias selection signal BSS based on display data DD. As described with reference to FIG. 1, the control logic 330 may generate the bias selection signal BSS based on a change in a data value of the display data DD. The control logic 330 may compare a data value of display data DD (e.g., current line data) corresponding to a pixel positioned in a line to be currently driven in a display panel PD and a data value of display data DD (e.g., previous line data) corresponding to a pixel positioned in a previously driven line, and may generate the bias selection signal BSS based on a comparison result.

For example, the control logic 330 may generate a bias selection signal BSS having a value for selecting the first bias voltage set VB_HP when a difference between the previous line data and the current line data is equal to or greater than a first reference value, generate a bias selection signal BSS having a value for selecting the second bias voltage set VB_MP when the difference between the previous line data and the current line data is less than the first reference value and is equal to or greater than a second reference value, and generate a bias selection signal BSS having a value for selecting the third bias voltage set VB_LP when the difference between the previous line data and the current line data is less than the second reference value.

The output buffer 321 may be biased based one of the first through third bias voltage sets VB_HP, VB_MP, and VB_LP. Accordingly, a static current ISB of the output buffer 321 may be divided into three steps and the output buffer 321 may operate in operation modes of three steps, for example, a high power operation mode, a medium power operation mode, and a low power operation mode.

The bias block 310 may generate four or more bias voltage sets, Thus, structures of the display driving circuits 100 and 300 may be variously changed based on descriptions of FIGS. 1 and 12.

Figure 13:
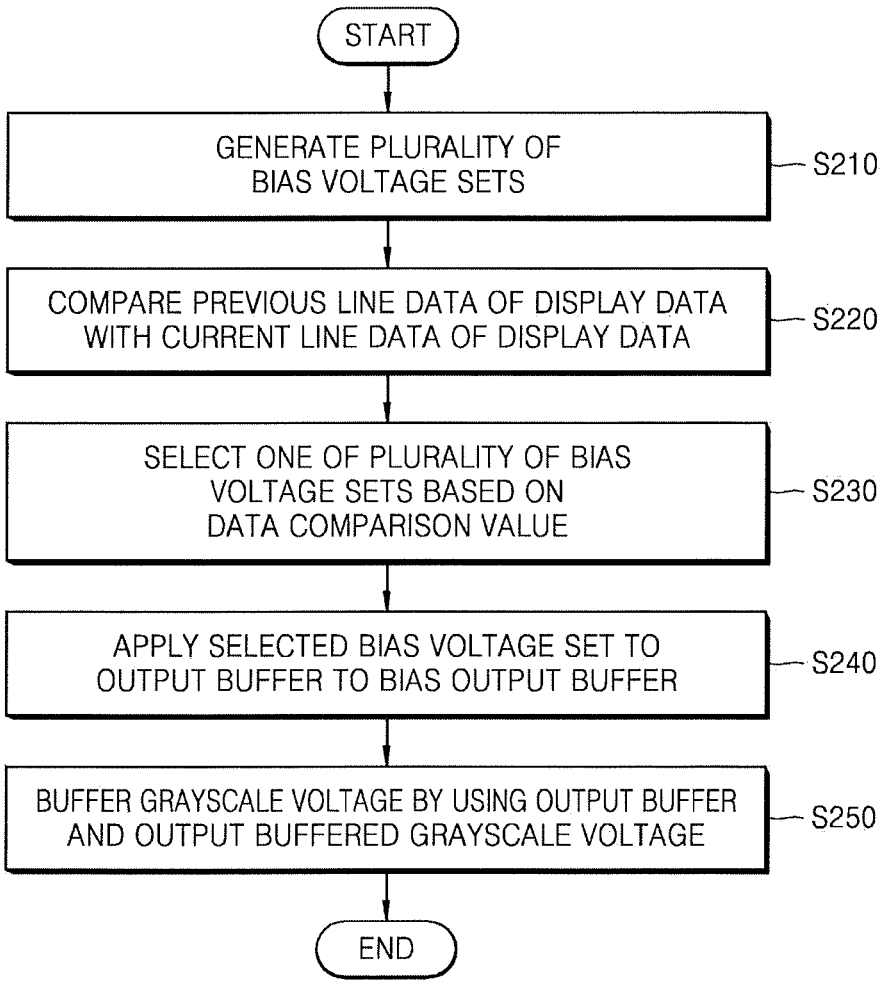
FIG. 13 illustrates another embodiment of a display driving method.

FIG. 13 illustrates another embodiment of a display driving method. Referring to FIG. 13, in this embodiment, a display driving circuit generates a plurality of bias voltage sets (operation S210). The bias voltage sets may include, for example, the same number of bias voltages. The amount of static current of an output buffer may be controlled according to levels of a plurality of bias voltages in each of the bias voltage sets.

When display data is applied, previous line data of the display data are compared with current line data of the display data (operation S220). One of the bias voltage sets is selected based on a data comparison value (operation S230). For example, when the bias voltage sets include three bias voltage sets, the data comparison value may correspond to one of three cases. Thus, one of the three bias voltage sets may be selected according to each case.

A selected bias voltage set is applied to the output buffer to bias the output buffer (operation S240). The output buffer buffers a grayscale voltage, which is applied to an input terminal thereof, and outputs the buffered grayscale voltage to a source line (operation S250). Operation S220 through operation S250 may be repeatedly performed whenever each line of a display panel is driven.

According to the display driving method according to the current exemplary embodiment, a static current corresponding to a bias voltage set selected according to a change in display data may flow to an output buffer. In addition, the static current of the output buffer may be reduced based on the display data, e.g., by adaptively controlling a slew rate of the output buffer in regard to an image.

Figure 14:
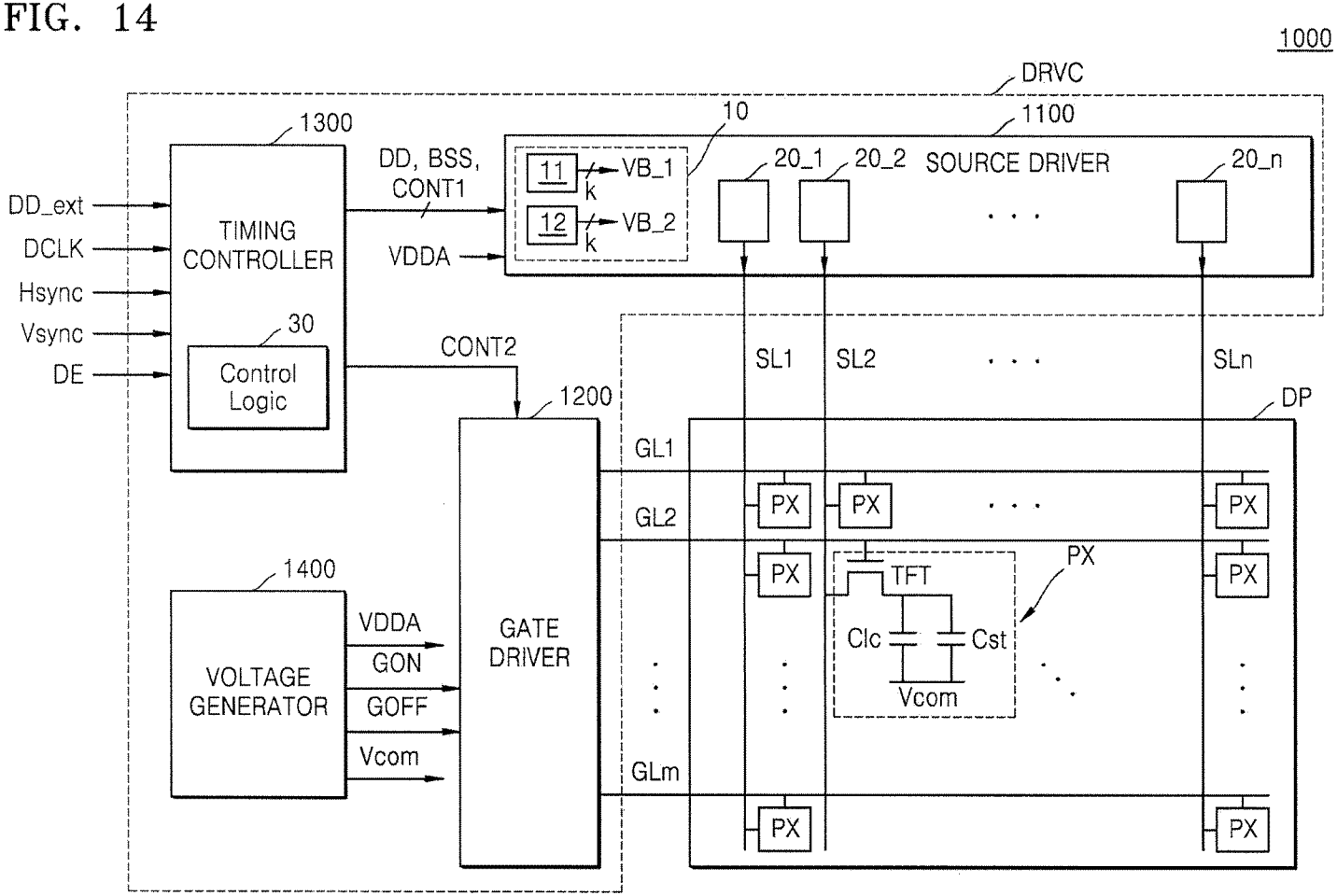
FIG. 14 illustrates an embodiment of a display device.

FIG. 14 illustrates an embodiment of a display device 1000 which includes a display panel DP and a driving circuit DRVC. The display panel DP displays an image in units of frames. The display panel DP may be implemented by a liquid crystal display (LCD), a light emitting diode (LED) display, an organic LED (OLED) display, an active-matrix OLED (AMOLED) display, a flexible display, or another kind of flat panel display (FPD). For the sake of convenience, an LCD panel will be taken as an example.

The display panel DP includes gate lines GL1 to GLm arranged in a row direction, source lines SL1 to SLn arranged in a column direction, and pixels PX formed at intersections of the gate lines GL1 to GLm and the source lines SL1 to SLn. In the LCD panel, a pixel PX includes a thin film transistor (TFT), a liquid crystal (LC) capacitor Clc connected to a drain of the TFT, and a storage capacitor Cst. A common voltage Vcom may be connected to the other ends of the LC capacitor C1*c* and the storage capacitor Cst. When the gate lines GL1 to GLm are sequentially scanned, TFTs of pixels PX connected to a selected gate line are turned on and a gray scale voltage corresponding to display data DD is applied to each of the source lines SL1 to SLn. The gray scale voltage is applied to the LC capacitor C1*c* and the storage capacitor Cst through a TFT of a corresponding pixel PX, and the LC capacitor C1*c* and the storage capacitor Cst are driven so that a display operation is performed.

The driving circuit DRVC may include a source driver 1100, a gate driver 1200, a timing controller 1300, and a voltage generator 1400. The driving circuit DRVC may be implemented by one semiconductor chip or a plurality of semiconductor chips.

The timing controller 1300 may receive display data DD_ext, a horizontal synchronizing signal Hsync, a vertical synchronizing signal Vsync, a clock signal CLK, and a data enable signal DE from an external device (for example, a host device) and may generate control signals BSS, CONT1, and CONT2 for controlling the gate driver 1200 and the source driver 1300 based on the received signals. In addition, the timing controller 1300 may generate display data DD obtained by converting a format of the display data DD_ext received, for example, from an external source to be suitable for an interface specification with the source driver 1100 and may transmit the display data DD to the source driver 1100.

The timing controller 1300 may include the control logic 30 described with reference to FIGS. 1, 6, 10, and 12. The control logic 30 may generate a bias selection signal (e.g., the control signal BSS) corresponding to each of a plurality of driving units 20_1 to 20_*n* of the source driver 1100 based on the display data DD_ext received from the external source In another exemplary embodiment, the control logic 30 may be in the source logic 1100.

The gate driver 1200 and the source driver 1100 drive the pixels PX of the display panel DP in accordance with the control signals BSS, CONT1, and CONT2 provided by the timing controller 1300.

The source driver 1100 drives the source lines SL1 to SLn of the display panel DP based on the control signal CONT1 that is a source driver control signal. The source driver 1100 may include a bias block 10 and the plurality of driving units 20_1 to 20_*n*. The bias block 10 may include a plurality of bias circuits 11 and 12 for generating a plurality of bias voltage sets VB_1 and VB_2, each of which includes a plurality of bias voltages. Each of the driving units 20_1 to 20_*n* may receive the bias voltage sets VB_1 and VB_2 and may select one of the bias voltage sets VB_1 and VB_2 based on a corresponding bias selection signal BSS. Bias voltages of a selected bias voltage set bias an output buffer in each of the driving units 20_1 to 20_*n*. A slew rate of the output buffer and a static current of the output buffer may be controlled by the selected bias voltage set.

The gate driver 1200 sequentially scans the gate lines GL1 to GLm of the display panel DP. The gate driver 1200 activates a selected gate line by applying a gate-on voltage GON to the selected gate line. The source driver 1100 outputs grayscale voltages corresponding to pixels connected to the activated gate line. Accordingly, an image may be displayed in units of horizontal lines (e.g., rows) on the display panel DP.

The voltage generator 1400 generates voltages to be used by the driving circuit DRVC and the display panel DP. The voltage generator 1400 may generate the gate-on voltage GON, a gate-off voltage GOFF, the common voltage Vcom, and an analog power supply voltage VDDA. The gate-on voltage GON and the gate-off voltage GOFF are provided to the gate driver 1200 and are used for generating gate signals applied to the gate lines GL1 to GLjm. The common voltage Vcom may be commonly provided to the pixels PX of the display panel DP. As illustrated in FIG. 14, the common voltage Vcom may be provided to one end of the LC capacitor C1*c* and one end of the storage capacitor Cst. The analog power supply voltage VDDA may be used when the source driver 1100 operates.

Figure 15:
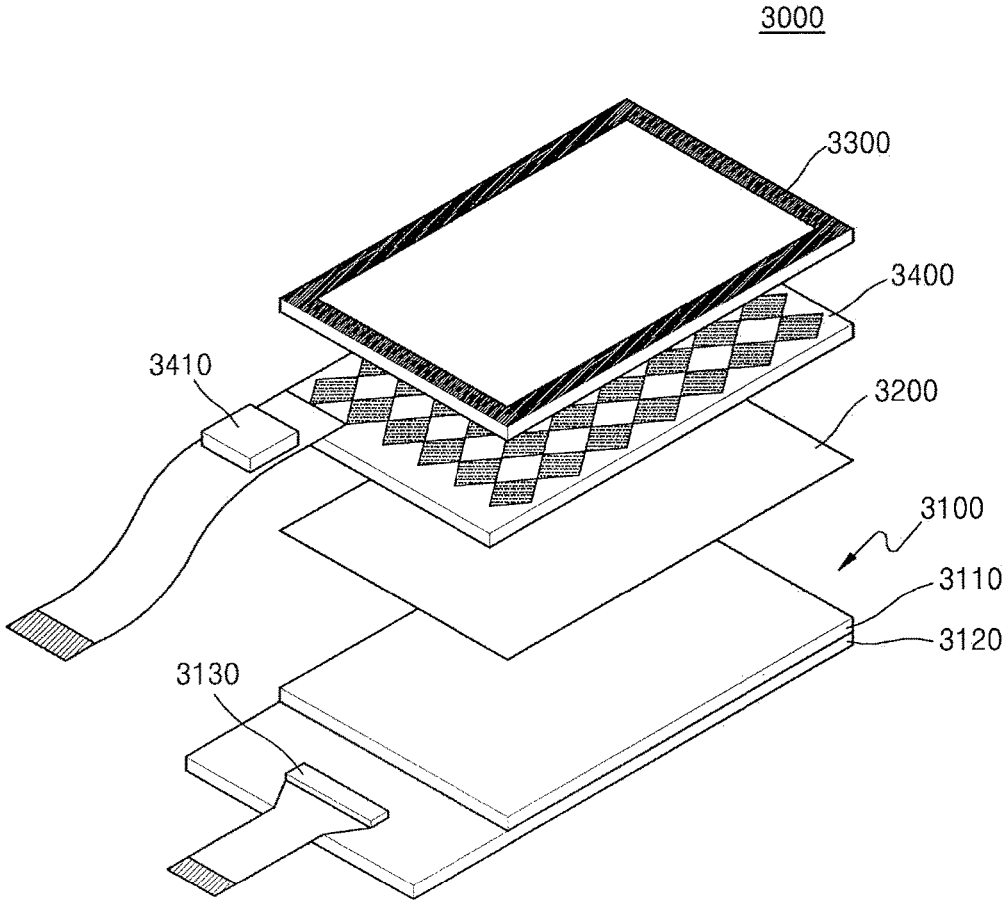
FIG. 15 illustrates an embodiment of a display module.

FIG. 15 illustrates an embodiment of a display module 3000 which includes a display device 3100, a polarizing plate 3200, and a window glass 3300. The display device 3100 includes a display panel 3110, a printed board 3120, and a display driving integrated circuit (IC) 3130.

The window glass 3300 is commonly formed, for example, of acryl or enhanced glass to protect the display module 3000 against external shock or scratches caused by repetitive touches. The polarizing plate 3200 may be provided in order to improve an optical characteristic of the display panel 3100. The display panel 3110 may be formed by patterning a transparent electrode on the printed board 3120. The display panel 3110 includes a plurality of pixels for displaying a frame. In an exemplary embodiment, the display panel 3110 may be a LC panel. The display panel 3110 may be a different type of panel in another embodiment. For example, the display panel 3110 may be an organic light emitting diode (OLED), an electrochromic display (ECD), a digital mirror device (DMD), an actuated mirror device (AMD), a grating light value (GLV), a plasma display panel (PDP), an electroluminescent display (ELD), a light emitting diode (LED) display, or a vacuum fluorescent display (VFD).

The display driving IC 3130 may include the display driving circuit 100, 100*a*, 200, or 300 according to the above-described exemplary embodiments.

According to the current exemplary embodiment, the display driving IC 3130 is illustrated as being one chip. However, the display driving IC 3130 may be formed of a plurality of chips in another embodiment. In addition, the display driving IC 3130 may be mounted on a glass printed board in a chip on glass (COG) type. The display driving IC 3130 may be mounted on different types of glass printed boards in other embodiments. These types include, for example, a chip on film (COF) type and a chip on board (COB) type.

The display module 3000 may further include a touch panel 3400 and a touch controller 3410. The touch panel 3400 may be formed by patterning a transparent electrode such as indium tin oxide (ITO) on a glass substrate or a polyethylene terephthalate (PET) film. The touch controller 3410 senses generation of a touch on the touch panel 3400, calculates touch coordinates, and transmits the calculated touch coordinates to a host. The touch controller 3410 may be integrated with one semiconductor chip together with the display driving IC 3130.

Figure 16:
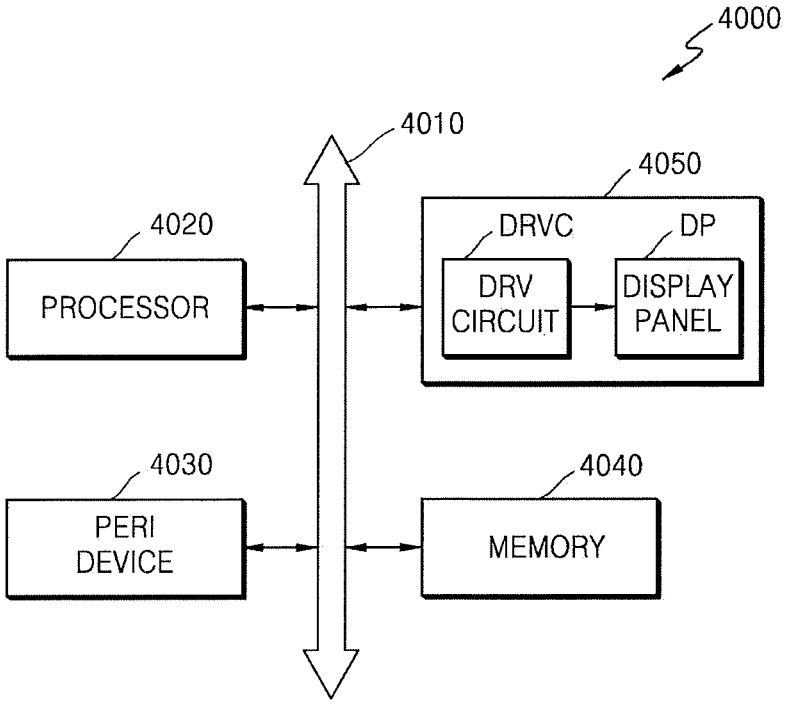
FIG. 16 illustrates an embodiment of a display system.

FIG. 16 illustrates an embodiment of a display system 4000 which includes a processor 4020 electrically connected to a system bus 4010, a display device 4050, a peripheral device 4030, and a memory 4040.

The processor 4020 controls input and output of data of the peripheral device 4030, the memory 4040, and the display device 4050 and may process image data transmitted among the devices. The display device 4050 includes a display panel DP and a display driving IC DRVC and stores image data items applied through the system bus 4010 in a frame memory or a line memory in the display driving IC DRVC and displays the stored image data items on the display panel DP. The display device 4050 may be the display device 1000 of FIG. 13. The display driving IC DRVC may include the display driving circuit 100, 100*a*, 200, or 300 according to the above-described exemplary embodiments.

The peripheral device 4030 may be a device for converting moving pictures or still images of a camera, a scanner, and a web camera into electrical signals. The image data obtained through the peripheral device 4030 may be stored in the memory 4040 or may be displayed on a panel of the display device 4050 in real time. The memory 4040 may include a volatile memory device such a dynamic random access memory (DRAM) and/or a non-volatile memory device such as a flash memory. The memory 4040 may be a DRAM, a parameter RAM (PRAM), a magnetoresistive RAM (MRAM), a resistive RAM (ReRAM), a ferroelectric RAM (FRAM), a NOR flash memory, a NAND flash memory, or a fusion flash memory (for example, a memory obtained by combining a static RAM (SRAM) buffer, a NAND flash memory, and a NOR interface logic). The memory 4040 stores image data obtained by the peripheral device 4030 or may store image signals processed by the processor 4020.

The display system 4000 according to an exemplary embodiment may be provided in an electronic product such as a tablet PC, a TV, or in various other kinds of electronic products that display images.

Figure 17:
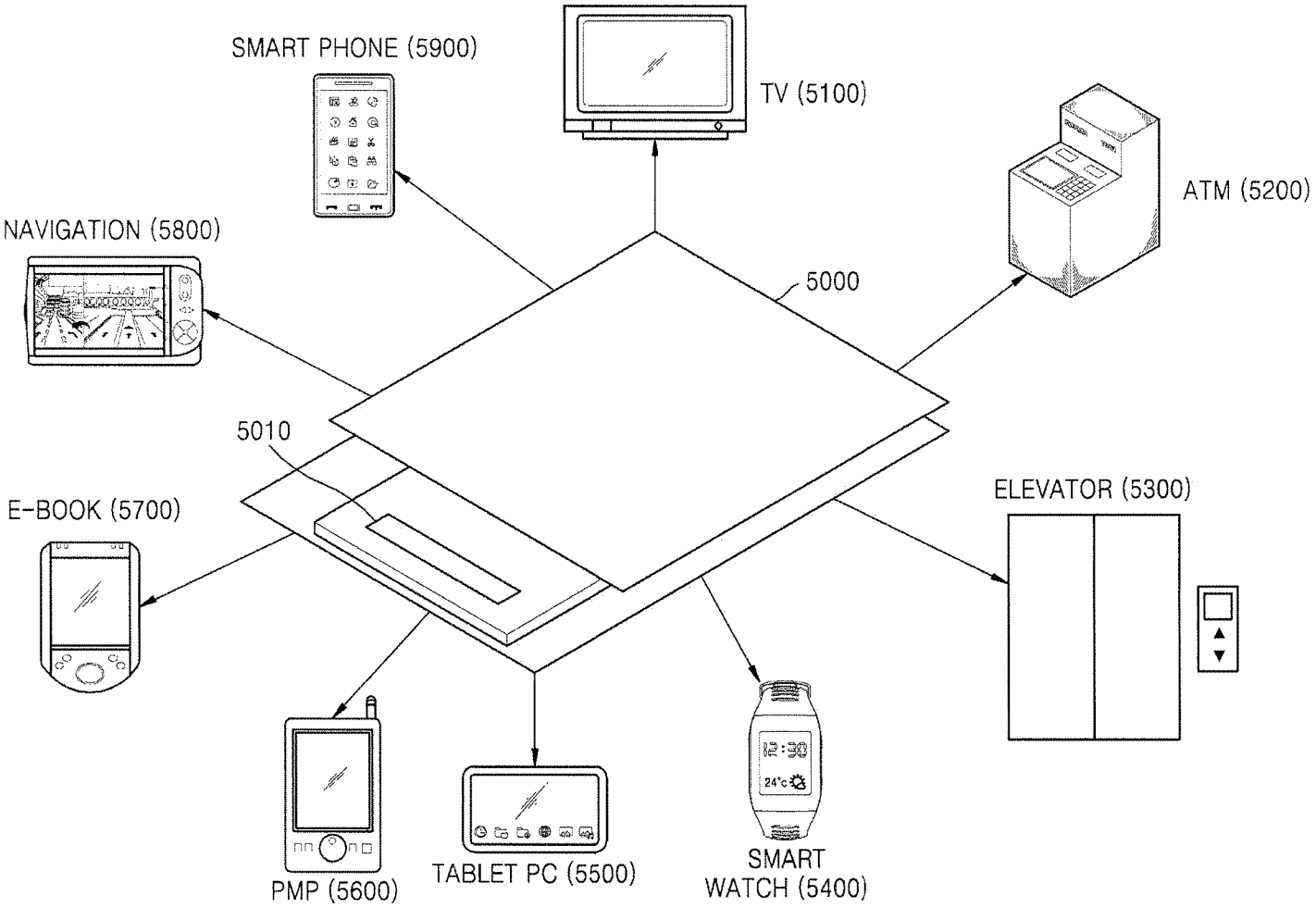
FIG. 17 illustrates examples electronic products including a display device.

FIG. 17 illustrates examples of various electronic products, each of which includes or is coupled to a display device 5000. The display device 5000 may be included or coupled to, for example, a TV 5100, an automated teller machine (ATM) 5200 that automatically performs cash-based transactions of a bank, an elevator 5300, a smart watch 5400, a tablet PC 5500, a portable multimedia player (PMP) 5600, an e-book 5700, a navigator 5800, or a smart phone 5900. In addition, the display device 5000 may be mounted in a wearable electronic device.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The control logic, driving units, and other processing features of the embodiments disclosed herein may be implemented in logic which, for example, may include hardware, software, or both. When implemented at least partially in hardware, the control logic, driving units, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the control logic, driving units, and processing features may include or be coupled to, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In accordance with another embodiment, an apparatus for a display device includes an input to receive a bias selection signal and logic to select a first bias voltage set or a second bias voltage set based on a bias selection signal. The selected one of the first bias voltage set or the second bias voltage set is used to bias an output buffer for storing a grayscale voltage corresponding to display data. The first bias voltage set corresponds to a first amount of static current of the output buffer and the second bias voltage set corresponds to a second amount of static current of the output buffer.

The input may be may take various forms. For example, when the logic is embodied within an integrated circuit chip, the output may be one or more output terminals, leads, wires, ports, signal lines, or other type of interface or input without or coupled to the logic. The logic may perform operations corresponding to any of the aforementioned embodiments. For example, the logic may include all or a portion of driving unit 20 and/or control logic 30. If the logic is implemented in software (e.g., code or instructions stored in a storage area), the input may be code for receiving information corresponding to the bias selection signal.

In one embodiment, the logic includes control logic to generate the bias selection signal and a selector to select the first bias voltage set or the second bias voltage set based on the bias selection signal. The control logic may be control logic 30 and the selector may be multiplexer 22, for example. The control logic may generate the bias selection signal based on a difference between a data value of current line data of the display data and a data value of previous line data of the display data.

In accordance with another embodiment, a computer-readable medium, e.g., a non-transitory computer-readable medium, stores the code or instructions for implementing the operations of the embodiments disclosed herein. The computer-readable medium may be a volatile or non-volatile memory or other storage device, which may be removably or fixedly coupled to the computer, processor, controller, or other signal processing device which is to execute the code or instructions for performing the method embodiments described herein.

In accordance with another embodiment, a method for controlling a display device includes storing code in a storage area, the code including: first code to select a first bias voltage set or a second bias voltage set based on a bias selection signal, second code to bias an output buffer based on the selected one of the first bias voltage set or the second bias voltage set, the output buffer to store a grayscale voltage corresponding to display data, wherein the first bias voltage set corresponds to a first amount of static current of the output buffer and the second bias voltage set corresponds to a second amount of static current of the output buffer.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A display driving circuit, comprising:

a first bias circuit to generate a first bias voltage set;

a second bias circuit to generate a second bias voltage set;

a selector to select the first bias voltage set or the second bias voltage set based on a bias selection signal, the selector to select the first bias voltage set when the bias selection signal has a first value and the second bias voltage set when the bias selection signal has a second value; and an output buffer to buffer a grayscale voltage corresponding to display data and output the buffered grayscale voltage, the output buffer to be biased based on the first or second bias voltage set selected by the selector, wherein the bias selection signal is to be set to the first bias voltage when a difference between a data value of current line data of the display data and a data value of previous line data of the display data is is equal to or greater than a predetermined reference value, and the bias selection signal is to be set to the second bias voltage set when the difference is less than the predetermined reference value.

2. The display driving circuit as claimed in claim 1, wherein:

the output buffer includes a plurality of stages, each of the stages includes an input terminal and an output terminal, and when the first or second bias voltage set selected by the selector is changed, a static current flowing through each of the stages is to be changed.

3. The display driving circuit as claimed in claim 2, wherein static currents flowing through the stages are to be changed at substantially a same rate.

4. The display driving circuit as claimed in claim 1, wherein levels of a plurality of bias voltages of the second bias voltage set are different from levels of a plurality of bias voltages of the first bias voltage set.

5. The display driving circuit as claimed in claim 1, wherein an amount of static current of the output buffer when the output buffer is biased by the first bias voltage set is greater than that of the output buffer when the output buffer is biased by the second bias voltage set.

6. The display driving circuit as claimed in claim 1, further comprising:

control logic to compare current line data of the display data with previous line data of the display data and to generate the bias selection signal based on a result of the comparison.

7. The display driving circuit as claimed in claim 6, wherein the control logic includes:

a line buffer to receive the display data and output the received display data as the previous line data; and a comparator to compare the current line data of the display data with the previous line data of the display data and to generate the bias selection signal based on a result of the comparison.

8. The display driving circuit as claimed in claim 1, wherein voltage levels of a plurality of bias voltages of the first and second bias voltage sets vary based on a bias control signal.

9. The display driving circuit as claimed in claim 8, wherein the bias control signal is to be set based on a driving load of the output buffer according to one or more characteristics of a display panel.

10. The display driving circuit as claimed in claim 1, further comprising:

a third bias circuit to generate a third bias voltage set, wherein the selector is to select one of the first through third bias voltage sets based on the bias selection signal.

11. A display driving circuit, comprising:

a bias block to generate a plurality of bias voltage sets, each of the bias voltage sets including k bias voltages, where k is a positive integer; and a plurality of drivers to drive a plurality of source lines of a display panel, each of the drivers to receive the bias voltage sets, wherein each of the drivers includes an output buffer to output a grayscale voltage corresponding to display data, to select only one of the bias voltage sets based on a change in the display data, and to bias the output buffer based on the k bias voltages of the selected bias voltage set, wherein each of the drivers is to select a first one of the bias voltage sets when a select signal has a first value indicative of a first change in the display data and to select a second one of the bias voltage sets when the select signal has a second value indicative of a second change in the display data different from the first change in the display data.

12. The display driving circuit as claimed in claim 11, further comprising:

control logic to compare previous line data of display data corresponding to each of the drivers with current line data of the display data, to generate the bias selection signal based on a result of the comparison, and to provide the bias selection signal and the display data to a corresponding driver.

13. The display driving circuit as claimed in claim 12, wherein the output buffer is to output a grayscale voltage corresponding to the display data.

14. An apparatus for a display device, comprising:

an input to receive a bias selection signal; and logic to select a first bias voltage set or a second bias voltage set based on a bias selection signal, the selected one of the first bias voltage set or the second bias voltage set to bias an output buffer for storing a grayscale voltage corresponding to display data, wherein the logic is to select the first bias voltage set when the bias selection signal has a first value and the second bias voltage set when the bias selection signal has a second value, and wherein the first bias voltage set corresponds to a first amount of static current of the output buffer and the second bias voltage set corresponds to a second amount of static current of the output buffer, and wherein the first value indicates that a difference between a data value of current line data of the display data and a data value of previous line data of the display data is equal to or greater than a predetermined reference value, and the second value indicates that the difference is less than the predetermined reference value.

15. The apparatus as claimed in claim 14, wherein the logic includes control logic to generate the bias selection signal.

16. The apparatus as claimed in claim 15, wherein the control logic is to generate the bias selection signal based on a difference between a data value of current line data of the display data and a data value of previous line data of the display data.

17. The apparatus as claimed in claim 14, wherein the logic corresponds to instructions stored in a storage area.

18. The apparatus as claimed in claim 14, wherein the input is an input of code implementing the logic.

* * * * *